US009849955B1

(12) United States Patent
Kiekhaefer

(10) Patent No.: US 9,849,955 B1
(45) Date of Patent: Dec. 26, 2017

(54) MARINE SURFACE PROPULSION DEVICE

(71) Applicant: Fred Kiekhaefer, Castle Rock, CO (US)

(72) Inventor: Fred Kiekhaefer, Castle Rock, CO (US)

( * ) Notice: Subject to any disclaimer, the term of this patent is extended or adjusted under 35 U.S.C. 154(b) by 0 days.

(21) Appl. No.: 15/397,513

(22) Filed: Jan. 3, 2017

(51) Int. Cl.

| | |
|---|---|
| ***B63H 3/00*** | (2006.01) |
| ***B63H 3/08*** | (2006.01) |
| ***B63H 1/14*** | (2006.01) |
| ***B63H 23/34*** | (2006.01) |
| ***B63H 5/125*** | (2006.01) |
| ***B63H 25/42*** | (2006.01) |

(52) U.S. Cl.
CPC ..... *B63H 3/08* (2013.01); *B63H 1/14* (2013.01); *B63H 5/125* (2013.01); *B63H 23/34* (2013.01); *B63H 25/42* (2013.01); *B63B 2748/00* (2013.01)

(58) Field of Classification Search
CPC ..... B63H 3/08; B63H 5/125; B63H 23/34; B63H 25/42
USPC ..... 440/50
See application file for complete search history.

(56) References Cited

U.S. PATENT DOCUMENTS

| | | | | |
|---|---|---|---|---|
| 3,376,842 | A | 4/1968 | Wynne | |
| 3,501,251 | A | 3/1970 | Haglund et al. | |
| 3,610,644 | A | 10/1971 | Swanson et al. | |
| 3,794,441 | A | 2/1974 | Johnson | |
| 3,802,800 | A | 4/1974 | Merkx et al. | |
| 3,913,517 | A | 10/1975 | Lohse et al. | |
| 4,810,166 | A | 5/1989 | Sawizky et al. | |
| 4,907,992 | A | 3/1990 | Cavallaro et al. | |
| 5,145,318 | A | 9/1992 | Olson | |
| 5,795,132 | A | 8/1998 | Wheeler | |
| 6,332,818 | B1 | 12/2001 | Duncan et al. | |
| 6,340,290 | B1 | 1/2002 | Schott et al. | |
| 6,379,114 | B1 | 4/2002 | Schott et al. | |
| 7,927,160 | B1 * | 4/2011 | Noble | B63H 3/02 416/168 R |
| 2006/0057910 | A1 * | 3/2006 | Stallings | B63H 20/08 440/79 |
| 2008/0261468 | A1 * | 10/2008 | Mueller | B63H 1/14 440/50 |
| 2010/0150720 | A1 | 6/2010 | Duncan | |

* cited by examiner

*Primary Examiner* — Stephen P Avila
(74) *Attorney, Agent, or Firm* — Marsh Fischmann & Breyfogle LLP

(57) ABSTRACT

An embodiment of a device for marine surface propulsion of a watercraft is provided that facilitates high speed performance in combination with steering and/or trimming control. The propulsion device may include a support member supportably interconnectable to and pivotable about one or both of a reclined axis and upright axis relative to a watercraft transom. A propeller shaft may be supported by the support member for pivotable movement therewith, and may have a first end interconnectable to a watercraft engine output. A hub body and a plurality of propeller blades may be interconnected to a second end of the propeller shaft for co-rotation therewith, wherein the hub body and propeller blades are pivotable with the support member about the reclined and/or upright axes. A variable pitch actuator may be interconnected to the support member for pivotable co-movement therewith about the reclined and/or upright axis, wherein the variable pitch actuator is provided for adjustably controlling a pitch orientation of the propeller blades.

23 Claims, 16 Drawing Sheets

MARINE SURFACE PROPULSION DEVICE

BACKGROUND OF THE INVENTION

High-speed watercraft present a number of design challenges. In particular, to realize optimal thrust, the utilization of a variable pitch propeller is desirable. However, implementation of variable pitch propellers has entailed fixed propeller shaft tethering of the propellers to the watercraft. In turn, the performance of steering and/or trimming componentry has been compromised, thereby reducing maneuverability and/or performance.

SUMMARY OF THE INVENTION

The present disclosure is directed to improved devices for marine surface propulsion of a watercraft. In some embodiments, the device may include a support member supportably interconnectable to a watercraft transom and pivotable about at least a first axis, a propeller shaft supported by the support member for pivotable movement therewith about the first axis and rotatable relative to the support member, wherein a first end of the propeller shaft is interconnectable to a watercraft engine output for driven rotation thereby. The device may further include a hub body interconnected to a second end of the propeller shaft for co-rotation therewith, wherein the hub body is pivotable with the support member about the first axis, and a plurality of propeller blades projecting away from the hub body and interconnected to the second end of the propeller shaft for co-rotation therewith, wherein the plurality of propeller blades are pivotable with the support member about the first axis. Further, the device may include a variable pitch actuator, interconnected to the support member for pivotable co-movement therewith about the first axis, for adjustably controlling a pitch orientation of the plurality of propeller blades (e.g. relative to a longitudinal axis of the propeller shaft) and disposed for co-rotation with the propeller shaft.

As may be appreciated, the provision of a marine surface propulsion device having a support member that is supportably interconnectable to and pivotable about at least a first axis relative to a watercraft transom, and variable pitch actuator that is interconnected to the support member for pivotable co-movement therewith (e.g. co-rotation about a longitudinal axis of the propeller shaft), advantageously yields an arrangement that facilitates optimized propulsion by the variable pitch actuator in combination with at least one of steering and trimming control via pivotable adjustment of the support member relative to the first axis, wherein such steering and/or trimming control may occur concurrently with adjustable control of the pitch orientation of the plurality of propeller blades by the variable pitch actuator. Such arrangement facilitates further operative benefits as will be appreciated upon consideration of the various combinative features addressed hereinbelow.

In an embodiment in which the first axis is a reclined axis (e.g. a substantially horizontal axis or an axis that extends at an angle of +/−10° relative to horizontal), the device may further include a trimming actuator for adjustably pivoting the support member, propeller shaft, hub body, plurality of propeller blades and variable pitch actuator together about the reclined first axis, wherein the trimming actuator may be controlled concurrently with adjustable control of the pitch orientation of the plurality of propeller blades by the variable pitch actuator. In another embodiment in which the first axis is an upright axis (e.g. a substantially vertical axis or an axis that extends at an angle of +/−15° relative to vertical), the device may further include at least one or a pair of steering actuators for adjustably pivoting the support member, propeller shaft, hub body, plurality of propeller blades and variable pitch actuator together about the upright first axis, wherein the steering actuator(s) may be controlled concurrently with adjustable control of the pitch orientation of the plurality of propeller blades by the variable pitch actuator. In one arrangement, a first steering actuator may be interconnected between the support member and a watercraft transom or component supportably interconnected thereto on a first side of the upright first axis, and a second steering actuator may be interconnected between the support member and a watercraft transom or component supportably interconnected thereto on a second side of the upright first axis.

In some embodiments, the support member may be advantageously provided to be pivotable about both a first axis and a second axis, wherein the first axis and second axis are transverse and extend substantially within a common plane, and wherein the propeller shaft, hub body, plurality of propeller blades and variable pitch actuator are pivotable together with the support member about the first axis and about the second axis. In conjunction with such embodiments, the first axis may be an upright axis and the device may further include a gimbal member supportably interconnectable to and pivotable about the upright first axis relative to a watercraft transom. In turn, the support member may be supportably interconnected to and pivotable about the upright first axis with the gimbal member.

In some embodiments, the device may include at least one steering actuator interconnectable between a watercraft transom and the gimbal member for adjustably pivoting together the gimbal member, support member, propeller shaft, hub body, plurality of propeller blades and variable pitch actuator about an upright first axis. In some arrangements, a first steering actuator may be interconnected between the gimbal member and a watercraft transom on a first side of the upright first axis, and a second steering actuator may be interconnected between the gimbal member and a watercraft transom on a second side of the upright first axis.

In conjunction with such embodiments, the support member may be supportably interconnected to and pivotable about a reclined second axis relative to the gimbal member. In such embodiments, the device may further include a trimming actuator, interconnected between the gimbal member and support member, for adjustably pivoting the support member, propeller shaft, hub body, plurality of propeller blades and variable pitch actuator together about the reclined second axis. As may be appreciated, the provision of an arrangement having a variable pitch actuator interconnected to a support member for pivotable movement about both an upright first axis (e.g. for watercraft steering by one or more steering actuator(s)) and a reclined second axis (e.g. for watercraft trimming by a trimming actuator) yields an arrangement that facilitates optimized propulsion in dynamic combination with concurrent steering control and/or concurrent trimming control via selective pivotable adjustment of the support member.

In some approaches, the device may further include an input shaft that is supported by the support member for pivotable movement therewith about the first axis and the second axis, wherein the input shaft may be interconnectable to a watercraft engine for driven rotation thereby. In conjunction with such embodiments, the device may also include a plurality of meshing gears, wherein a first gear of the plurality of meshing gears is fixedly interconnected to the input shaft for co-rotation therewith, and wherein a second gear of the plurality of meshing gears may be disposed to rotate in response to rotation of the first gear. In turn, the first end of the propeller shaft may be fixedly interconnected to the second gear for co-rotation therewith. In conjunction with such arrangements, the first gear and second gear may be disposed at different elevations, e.g. the first gear may be elevated relative to the second gear, thereby facilitating positioning of the propeller shaft and interconnected propeller blades at an optimal position relative to the surface of a water body. Further, the number and/or relative sizes of gears of the plurality of meshing gearings may be selected to obtain desired over-speed and/or under-speed ratios.

In related embodiments, the device may include a first universal joint supportably interconnectable to a watercraft transom and rotatably interconnectable to a watercraft engine output for rotation thereby, and second universal joint supported by the support member for pivotable movement therewith about the first axis and about the second axis, and rotatably interconnected to the first universal joint for co-rotation therewith. In such embodiments, the first universal joint and the second universal joint may be interconnected free from direct connection with the gimbal member. In that regard, the first universal joint and second universal joint may be interconnected to extend through opposing side portions of the gimbal member, e.g. the interconnected first and second universal joints may extend through a yoke-configured portion of the gimbal member.

In some embodiments, the variable pitch actuator may comprise a linear actuator (e.g. a hydraulic linear actuator) that includes a housing fixedly interconnected to the support member, and a piston member having an end (e.g. a piston head portion) slidably disposed within the housing for linear and rotational movement relative thereto (e.g. linear movement along and rotational movement about a longitudinal axis of the propeller shaft), wherein the linear actuator is actuatable to control linear movement of the piston member and thereby adjust the pitch orientation of the plurality of propellers. In such embodiments, the device may include a force rod having a first end interconnected to the piston member (e.g. a piston rod portion that extends out of the housing) of the variable pitch actuator for linear and co-rotational movement therewith, and having a second end interconnected to the second end of the propeller shaft for co-rotation therewith, wherein the pitch orientation of the plurality of propellers (e.g. relative to a longitudinal axis of the propeller shaft) is adjustable in response to the linear movement of the force rod by the piston member of the variable pitch actuator.

In some implementations, the device may further include a pitch control member that may be fixedly interconnected to the second end of the propeller shaft for co-rotation therewith and to the second end of the force rod for linear and co-rotational movement therewith (e.g. linear movement along and rotational movement about a longitudinal axis of the propeller shaft). In turn, the pitch orientation of the plurality of propellers may be adjustable in response to the linear movement of the pitch control member by the force rod and the piston member. In some arrangements, the plurality of propellers may engage different corresponding ones of a plurality of guide surfaces provided by the pitch control member so as to rotate the plurality of propellers about corresponding axes to adjust the pitch orientation thereof in response to linear movement of the pitch control member by the force rod and piston member.

In some approaches, at least a portion of the propeller shaft may be tubular. In turn, the force rod may extend through at least a portion of the tubular portion of the propeller shaft to facilitate linear movement of the force rod and interconnected piston member relative to the propeller shaft. In that regard, in some approaches, the force rod may extend through a tubular propeller shaft from the first end to the second end thereof.

In contemplated embodiments, the device may further include a controller for automatically controlling operation of the variable pitch actuator that may be operated concurrent with operation of either or both of the at least one steering actuator(s) and trimming actuator. By way of example, the controller may comprise a computer processor configurable by preprogrammed instructions that utilize control algorithms to control the operation of the variable pitch actuator (e.g. to obtain optimal thrust) in relation to a watercraft engine throttle sensor output signal (e.g. to obtain optimal acceleration or de-acceleration to a desired speed), and optionally, concurrent with operation of the at least one steering actuator(s) and/or trimming actuator. In certain implementations, pitch magnitude may be automatically established by the control algorithms of the controller as a function of both a difference between a desired watercraft engine speed and an actual watercraft engine speed, in addition to the actual pitch position, or orientation, of the propeller blades as reflected by a sensor output signal indicative of a linear position of the piston member of the variable pitch actuator along a longitudinal axis of travel (e.g. relative to a longitudinal axis of the propeller shaft). The desired engine speed may be determined as a function of a position of either a throttle control or a throttle plate of an internal combustion watercraft engine, as indicated by an associated sensor output signal, and the actual engine speed may be determined as a function of a tachometer output signal. In that regard, controller functionality may be provided as described in U.S. Pat. No. 6,379,114, the entirety of which is incorporated herein by reference.

Further, in some embodiments the controller may be provided with preprogrammed instructions that utilize control algorithms to control the operation of the variable pitch actuator in relation to a trimming sensor output signal indicative of a positioning of a trimming actuator, and optionally, in co-relation to a watercraft engine throttle sensor output signal. The trimming sensor output signal may be provided by a sensor that senses operation/position of a trimming control device (e.g. a rocker switch controllable by a watercraft operator) and/or a sensor that senses a position of a piston member of a trimming actuator.

In one embodiment, at least two marine surface propulsion devices having features as described herein may be provided for supportable interconnection to and pivotable movement about a first axis and/or second axis relative to a watercraft transom. For example, a first propulsion device may be provided for interconnection to a watercraft transom on a first side (e.g. a port side) of a longitudinal axis (e.g. a lengthwise axis) of a watercraft, and a second propulsion device may be provided for interconnection to a watercraft transom on a second side (e.g. a starboard side) of the longitudinal axis of a watercraft. In turn, control algorithms may be provided so that the controller may automatically control the variable pitch actuators of the first and second propulsion devices to control the pitch orientation of each corresponding plurality of propeller blades in relation to operator steering and/or slowing of the watercraft.

For example, preprogrammed instructions may be provided that use control algorithms so that, in response to a watercraft engine throttle sensor output signal indicative of operator slowing of a watercraft, the controller may automatically control the first and second variable pitch actuators to reduce the magnitude of the pitch orientation of the propeller blades to a lower pitch orientation as a function of the desired degree of slowing. Further, the preprogrammed instructions may be provided with control algorithms so that, in response to processing of a steering control sensor signal (e.g. a signal indicative of a position of a watercraft steering wheel and/or a signal indicative of a position of a piston member of a steering actuator) indicative of operator steering of a watercraft to the left (i.e. to the port side), the controller may automatically control the first and second variable pitch actuators so that the propeller blades of the first variable pitch actuator automatically assume a first predetermined pitch orientation in relation to the desired steering moment and the propeller blades of the second variable pitch actuator automatically assume a second predetermined pitch orientation in relation to the desired steering moment, wherein the second predetermined pitch orientation is higher than the first predetermined pitch orientation. Conversely, the preprogrammed instructions may be provided with control algorithms so that, in response to processing of a steering control sensor signal (e.g. a signal indicative of a position of a watercraft steering wheel and/or a signal indicative of a position of a piston member of a steering actuator) indicative of operator steering of a watercraft to the right (i.e. to the starboard side), the controller may automatically control the first and second variable pitch actuators so that the propeller blades of the first variable pitch actuator automatically assume a first predetermined pitch orientation in relation to the desired steering moment and the propeller blades of the second pitch actuator automatically assume a second predetermined pitch orientation in relation to the desired steering moment, wherein the second predetermined pitch orientation is lower than the first predetermined pitch orientation.

Numerous additional features and advantages of the present invention will become apparent to those skilled in the art upon consideration of the embodiment descriptions provided hereinbelow.

DETAILED DESCRIPTION

FIGS. 1-8 illustrate one embodiment of a marine surface propulsion device for use with a watercraft, e.g. a high-speed watercraft. As will be described, the propulsion device comprises a variable pitch propeller which may be steered for directional control of a watercraft and tilted for enhanced thrust and attendant propulsion of a watercraft (i.e. "trimming"). A closed-loop control system may be utilized with the propulsion device to optimize pitch and trim for either maximum performance or best fuel economy, based upon a position of a throttle for controlling the output of an operatively interconnected watercraft engine. The described embodiment is not intended to be limiting and various described features may be implemented in modified arrangements.

Figure 1:
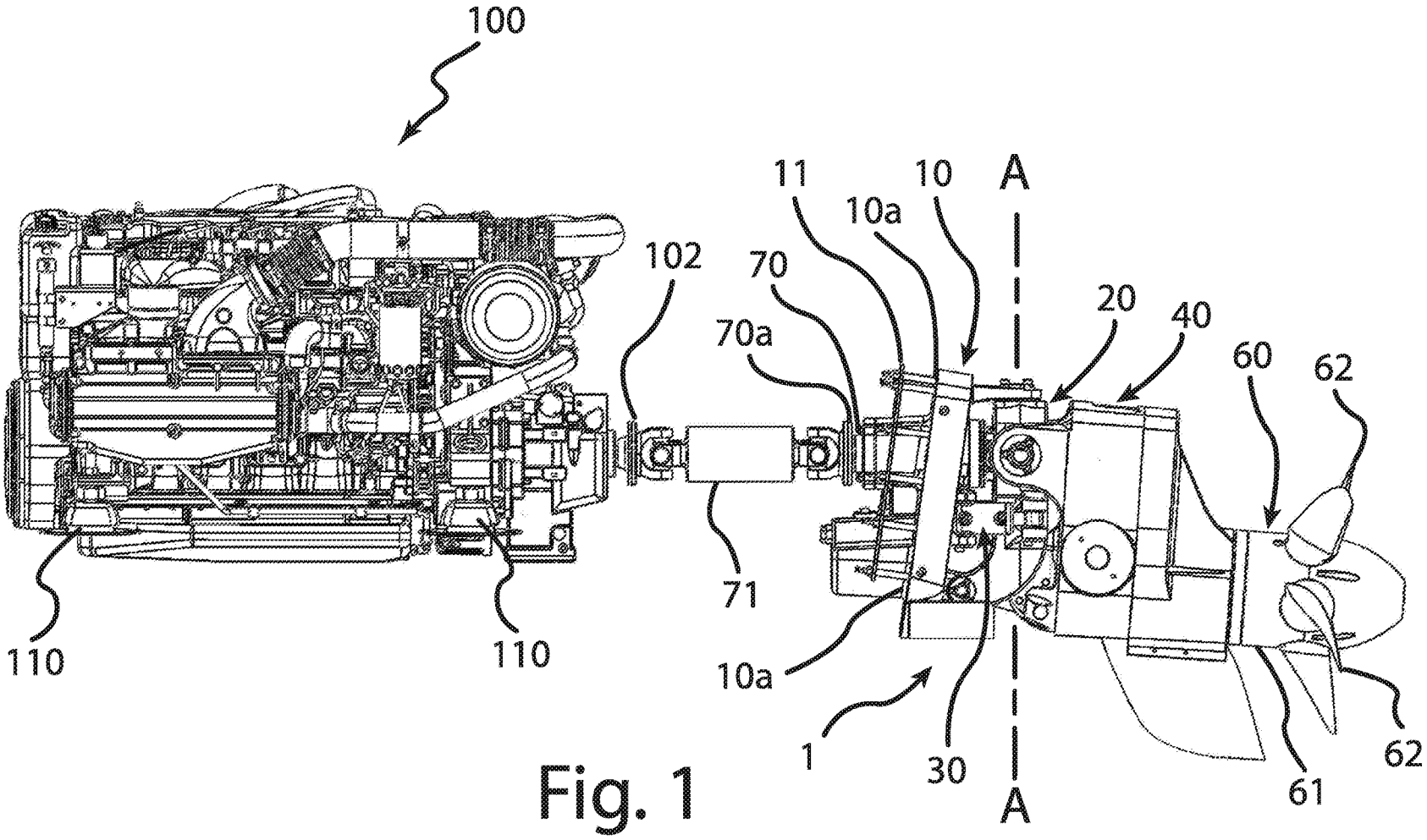
FIG. 1 illustrates one embodiment of a marine surface propulsion device operatively interconnected to a watercraft engine.

With reference to FIG. 1, an embodiment of propulsion device 1 may be provided for operative interconnection to a watercraft engine 100 that may be fixedly mounted within the hull of a watercraft to provide an output to rotate a variable pitch propeller 60 of the propulsion device 1, and more particularly, a hub body 61 and plurality of propeller blades 62 comprising variable pitch propeller 60, to propel the watercraft on a body of water. By way of example, mount brackets 110 may be interconnected to the watercraft engine 100. In turn, with reference to FIG. 2, the mount brackets 110 (not shown) may be fixedly mounted in a rear aspect of a watercraft 120, e.g. mounted to hull stringers 122.

Figure 2:
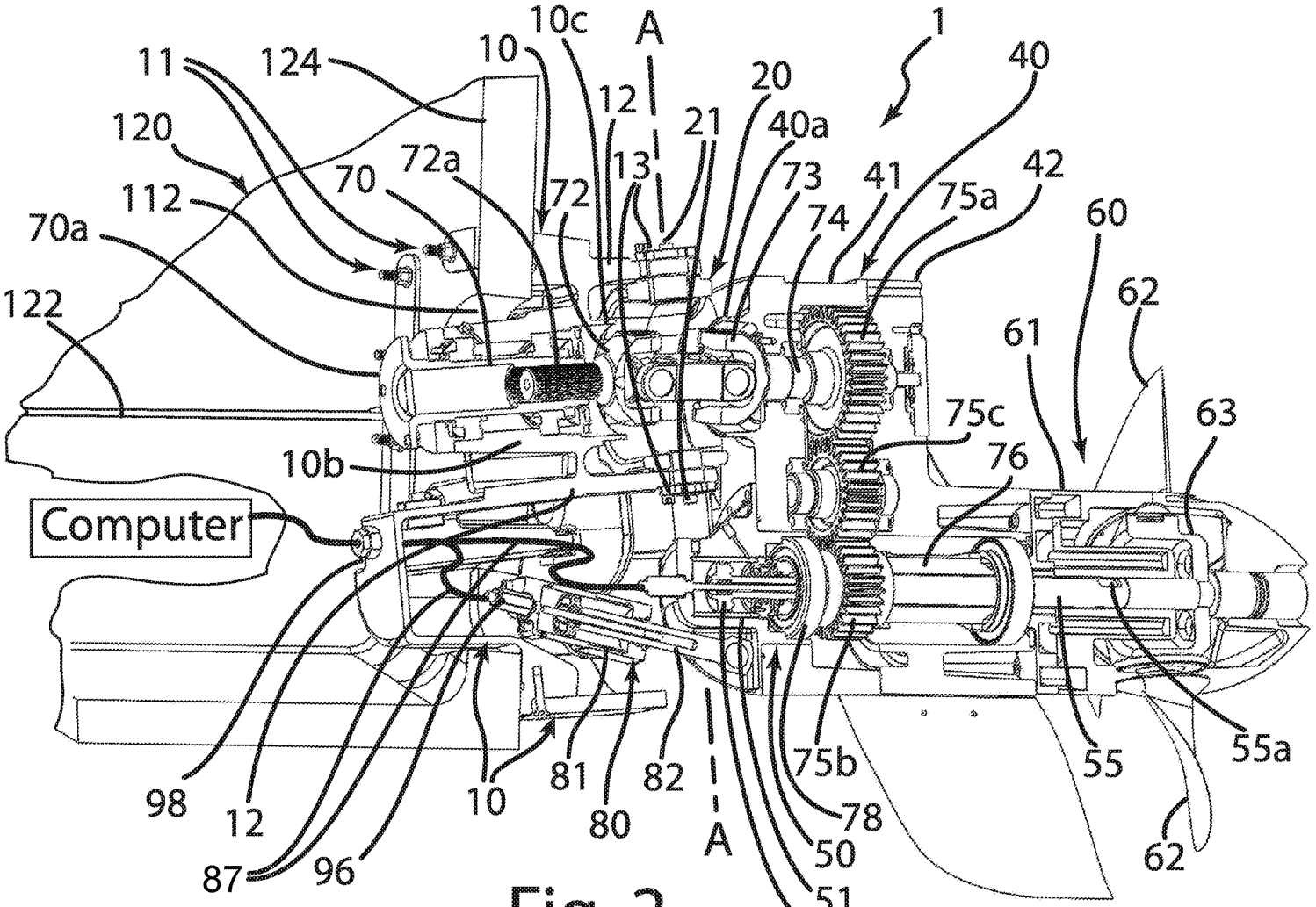
FIG. 2 is a cross-sectional view of the marine surface propulsion device embodiment of FIG. 1 supportably interconnected to a transom of a water craft.

With further reference to FIGS. 1 and 2, propulsion device 1 may include a transom mount member 10 that may be fixedly interconnectable to an aft surface of a transom 124 of the watercraft 120, e.g. interconnectable via a mount bracket assembly 11 that comprises a plurality of mounting bolts extending forwardly from an outer frame-like portion 10*a* of the transom mount member 10 for securement to transom 124. The frame-like portion 10*a* of the transom mount member 10 may present a flat forward surface for flush interface with a flat aft surface of the transom 124.

Figure 3:
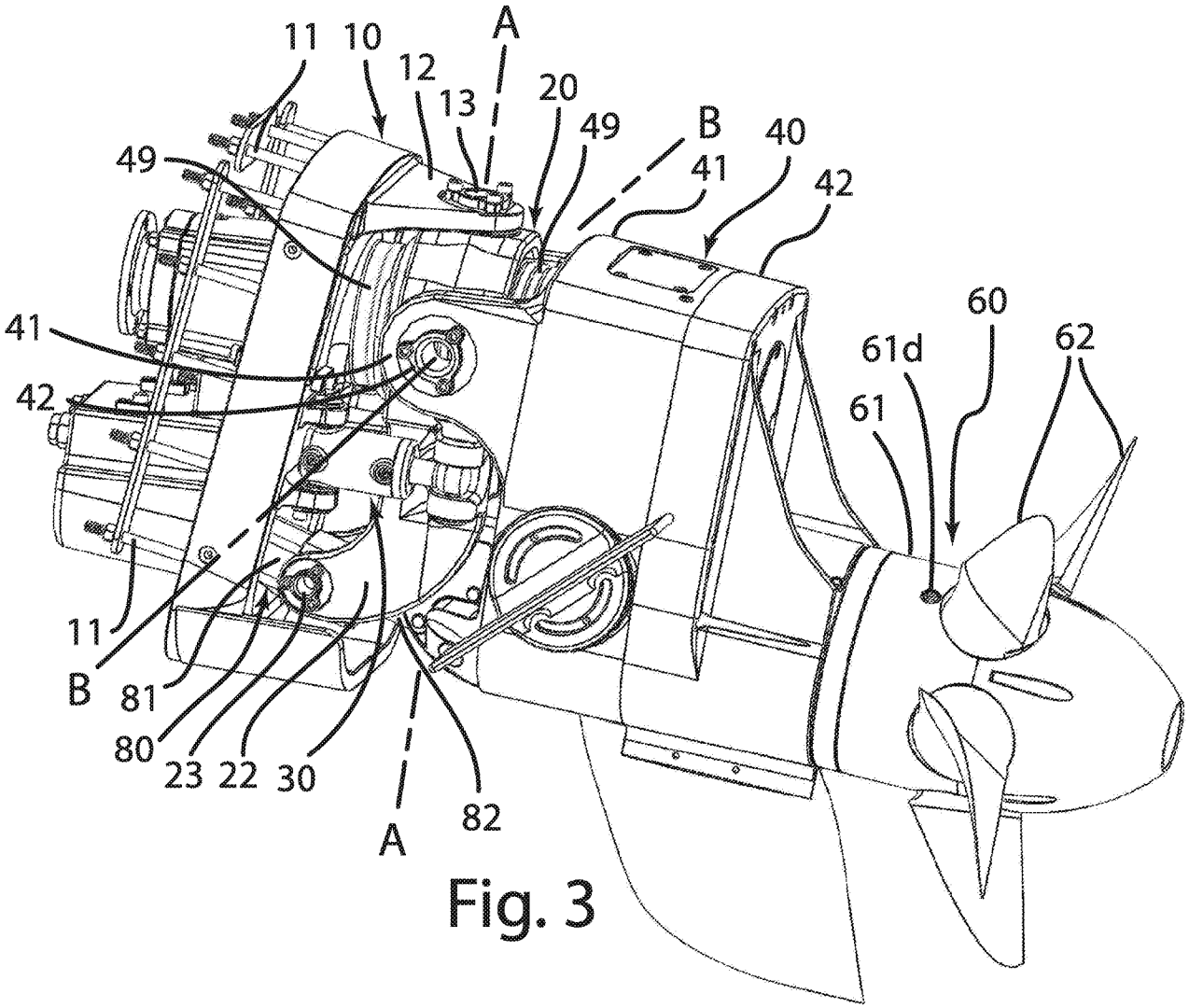
FIG. 3 is a side perspective view of the marine surface propulsion device embodiment of FIG. 1.

As shown in FIGS. 1, 2 and 3, propulsion device 1 may further include a gimbal member 20 supportably interconnected to the transom mount member 10 for pivotable movement about an upright axis AA and relative to transom mount member 10 and transom 124. For such purposes, the transom mount member 10 may comprise rearwardly projecting arms 12 to which gimbal member 20 may be supportably interconnected for pivotable movement about upright axis AA. For example, each rearwardly extending arm 12 may be provided with a bearing ring member 13 for receiving a complimentary, bearing pin member 21 of the gimbal member 20.

As shown in FIGS. 1 and 3, propulsion device 1 may further include one or more steering actuator 30 (e.g. one on each side of upright axis AA) interconnected between transom mount member 10 and gimbal member 20 for selective, controlled pivoting of the gimbal member 20 about upright axis AA for steering the watercraft 120. In the illustrated embodiment, steering actuators 30 may be hydraulic linear actuators.

With reference to FIGS. 2 and 3, propulsion device 1 may further include a support member 40 supportably interconnected to the gimbal member 20 for pivotable movement about the upright axis AA together with the gimbal member 20. For such purposes, support member 40 may include one or more forwardly extending arms 41 (e.g. one on each side of upright axis AA) that may be supportably interconnected to gimbal member 20 and pivotable relative to gimbal member 20 about a reclined axis BB, as shown in FIG. 3. For example, each forwardly extending arm 41 may be provided with a bearing ring member 42 for receiving a complimentary, bearing pin member (not shown) of the gimbal member 20.

With further reference to FIGS. 2 and 3, propulsion device 1 may also include a trimming actuator 80 supportably interconnected between the support member 40 and gimbal member 20 for pivotable movement about the upright axis AA together with gimbal member 20 and support member 40, variable pitch actuator 50 and variable pitch propeller 60. The trimming actuator 80 may be provided for selective, controlled pivoting of the support member 40, and variable pitch propeller 60 and variable pitch actuator 50 supportably interconnected thereto, about the reclined axis BB and relative to transom mount member 10 and transom 124.

In the illustrated embodiment, trimming actuator 80 may be a hydraulic linear actuator. In turn, trimming actuator 80 may comprise a housing 81 supportably and pivotably interconnected to a downward extending arm 22 of the gimbal member 20. For example, downward extending arm 22 may be provided with a bearing ring member 23 for receiving a complimentary, bearing pin member of the housing 81 of trimming actuator 80. Further, and as best shown in FIG. 2, trimming actuator 80 may comprise a piston member 82 supportably and slidably interconnected at a first end within housing 81 and supportably and fixedly interconnected at a second end to support member 40.

As shown in FIG. 2, propulsion device 1 may also include a variable pitch actuator 50 operatively interconnected to the variable pitch propeller 60, wherein the variable pitch actuator 50 and variable pitch propeller 60 are supported by the support member 40 for pivotable movement therewith about the upright axis AA and about the reclined axis BB. The variable pitch actuator 50 may be provided for adjustably controlling a pitch orientation of the propeller blades 62. In the illustrated embodiment, variable pitch actuator 50 may be a hydraulic linear actuator. In turn, variable pitch actuator 50 may comprise a housing 51 and piston member 52 supportably interconnected to support member 40, as will be further described.

As noted above in relation to FIGS. 1 and 2, propulsion device 1 may be provided for operative interconnection with watercraft engine 100. In that regard, watercraft engine 100 may provide for driven rotation of an output member, e.g. driven rotation of a drive flange 102, wherein the drive flange 102 may be selectively driven in a clockwise direction or in a counter clockwise direction. In turn, propulsion device 1 may comprise a drive assembly interconnectable to the drive flange 102 for driven rotation of the variable pitch propeller 60. The drive assembly may include a transom throughput shaft 70 having a forward flange 70*a* that may be interconnected to the output drive flange 102 for co-rotation therewith either directly or utilizing an optional drive line member 71 as illustrated in FIG. 1.

As shown in FIG. 2, the transom throughput shaft 70 may extend through a forward projecting portion 10*b* of the transom member 10 that projects through an opening 112 through transom 124. In turn, the throughput input shaft 70 may be interconnected to a double universal joint assembly comprising a first universal joint 72 supported by the transom mount member 10 and interconnected to a second universal joint 73 supported by the support member 40, wherein driven rotation of transom throughput shaft 70 effects co-rotation of first universal joint 72 and second universal joint 73. The double universal joint assembly may be located proximate an intersection of the upright axis AA and reclined axis BB, and enables drive power transmission from the transom throughput shaft 70 during steering and/or trimming operations. A forward extending shaft 72*a* of the first universal joint 72 may comprise external, longitudinal splines which telescope into an internally-splined, hollow shaft portion of the transom throughput shaft 70, thereby allowing a sliding interconnection to accommodate small axial displacements of the propulsion device 1 as the propulsion device 1 is trimmed or steered.

As shown in FIG. 2, the second universal joint 73 may be fixedly interconnected to an input shaft 74 for driven co-rotation of the input shaft 74, wherein the second universal joint 73 and input shaft 74 may be supported by and rotatable relative to the support member 30 for pivotable movement therewith about upright axis AA and reclined axis BB. In turn, the input shaft 74 may be interconnected to a plurality of meshing gears 75 and a propeller shaft 76 for driven rotation thereof, wherein the plurality of meshing gears 75 and propeller shaft 76 are also supported by and rotatable relative to the support member 40, and pivotable with support member 40 about the upright axis AA and reclined axis BB. As shown in FIG. 2, the double universal joint assembly may extend through an opening of a yoke-configured portion of the gimbal member. In turn, and as shown in FIG. 3, a flexible tubular outer sleeve member 49 may extend around the universal joint assembly through the opening of the gimbal member 20, wherein a first end of the sleeve member 49 may be sealably interconnected to a rearwardly projecting annular flange portion 10*c* of the transom mount member 10 (See FIG. 2) and a second end of the sleeve member 49 may be sealable interconnected to a forwardly projecting annular flange portion 40*a* of the support member 40 (See FIG. 2). In that regard, sleeve member 49 may define an enclosed water-free volume (e.g. a sealably enclosed volume), and the transom mount member 10 and support member 40 may each define corresponding enclosed, water-free volumes (e.g. sealably enclosed volumes), wherein the various illustrated and described componentry may be housed in the interconnected and enclosed, water-free volumes, including for example, transom throughput shaft 70 and associated bearings, and sensors 94 and 96 (described below) within transom mount member 10, the double universal joint assembly within sleeve member 49, and the input shaft 74 and associated bearings, meshing gears 75 and associated bearings, propeller shaft 76 and associated bearings, and at least a portion of variable pitch actuator 50 and associated bearings within support member 40.

In the illustrated embodiment, the plurality of meshing gears 75 includes a first gear 75*a* fixedly interconnected to the input shaft 74 for co-rotation therewith, and a second gear 75*b* fixedly interconnected to a first end of propeller shaft 76 (e.g. a tubular or hollow shaft) for driven rotation of the propeller shaft 76. The plurality of meshing gears 75 may further include a third gear 75*c* meshed with the first gear 75*a* and second gear 75*b* and may function as an idler gear.

In the illustrated arrangement, driven rotation of the first gear 75*a* in a first direction (e.g. clockwise) effects driven rotation of the third gear 75*c* in a second direction (e.g. counterclockwise) to effect driven rotation of the second gear 75*b* in the first direction (e.g. clockwise). The plurality of meshing gears may be provided to obtain desired overspeed or under-speed ratios, e.g. 1:1.5 overspeed or 1.4:1 speed reduction.

Figure 4:
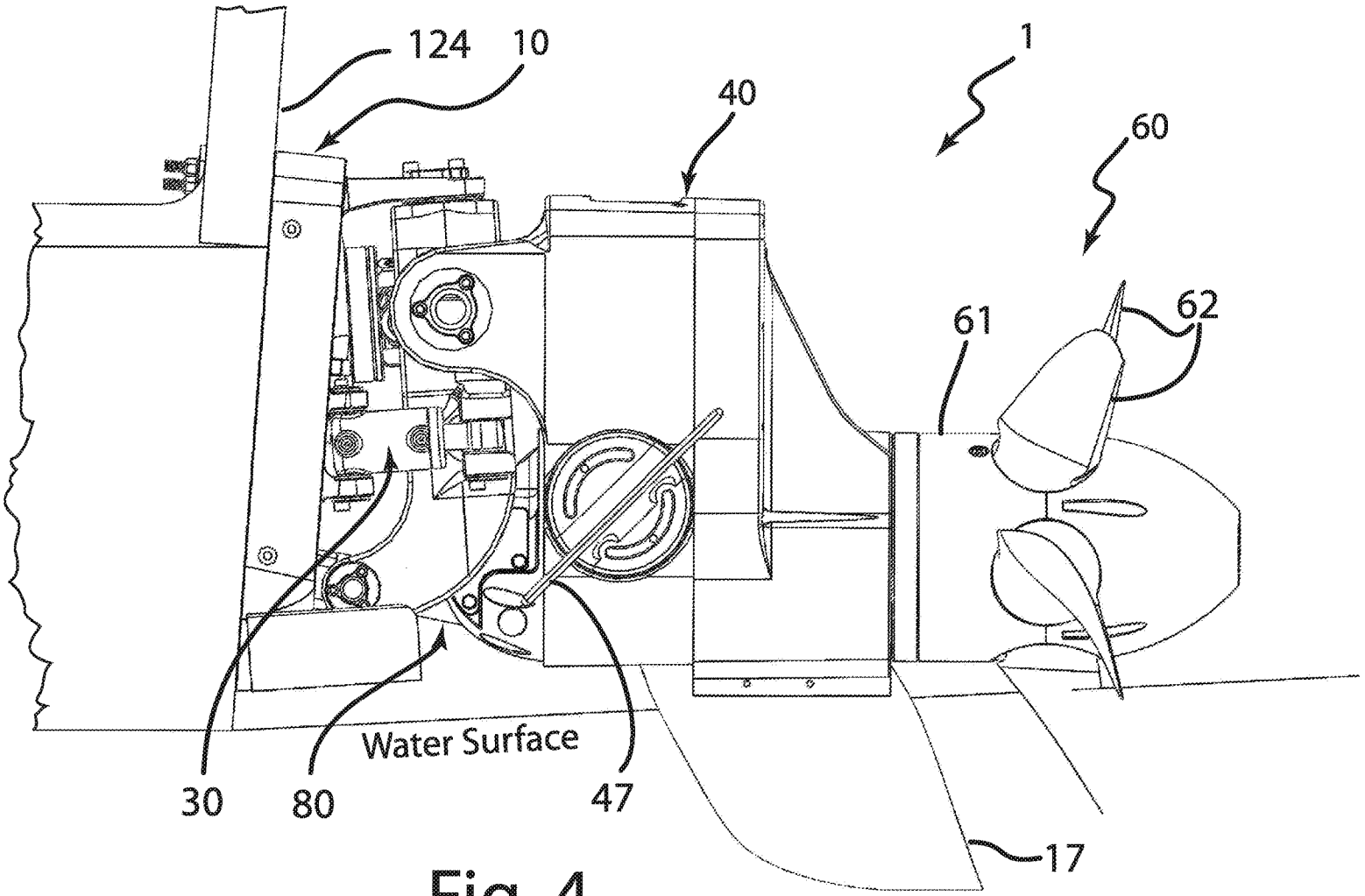
FIG. 4 is a side view of the marine surface propulsion device embodiment of FIG. 1 as positioned for operative use relative to the surface of a body of water.

As illustrated, the second gear 75*b* and third gear 75*c* may be disposed at locations lower than the location of the first gear 75*a*, thereby facilitating interconnection of the second gear 75*b* with propeller shaft 76 at a "dropped" location relative to input shaft 74. Such arrangement facilitates driven rotation of the propeller blades 62 at the surface of a water body with rudder 17 extending below the water surface, as shown in FIG. 4. For example, the propeller blades 62 may be located to successively enter in to and pass out of the water as they rotate with hub body 61.

With further reference to FIG. 2, the hub body 61 and propeller blades 62 of variable pitch propeller 60 may be interconnected to a second end of the propeller shaft for co-rotation therewith. More particularly, a pitch control member 63 may be fixedly interconnected to the second end of the propeller shaft 76 for co-rotation therewith, and each of the propeller blades 62 may comprise corresponding flanges captured between the hub body 61 and corresponding guide surfaces provided by the pitch control member 63, as will be further described.

Figure 6A:
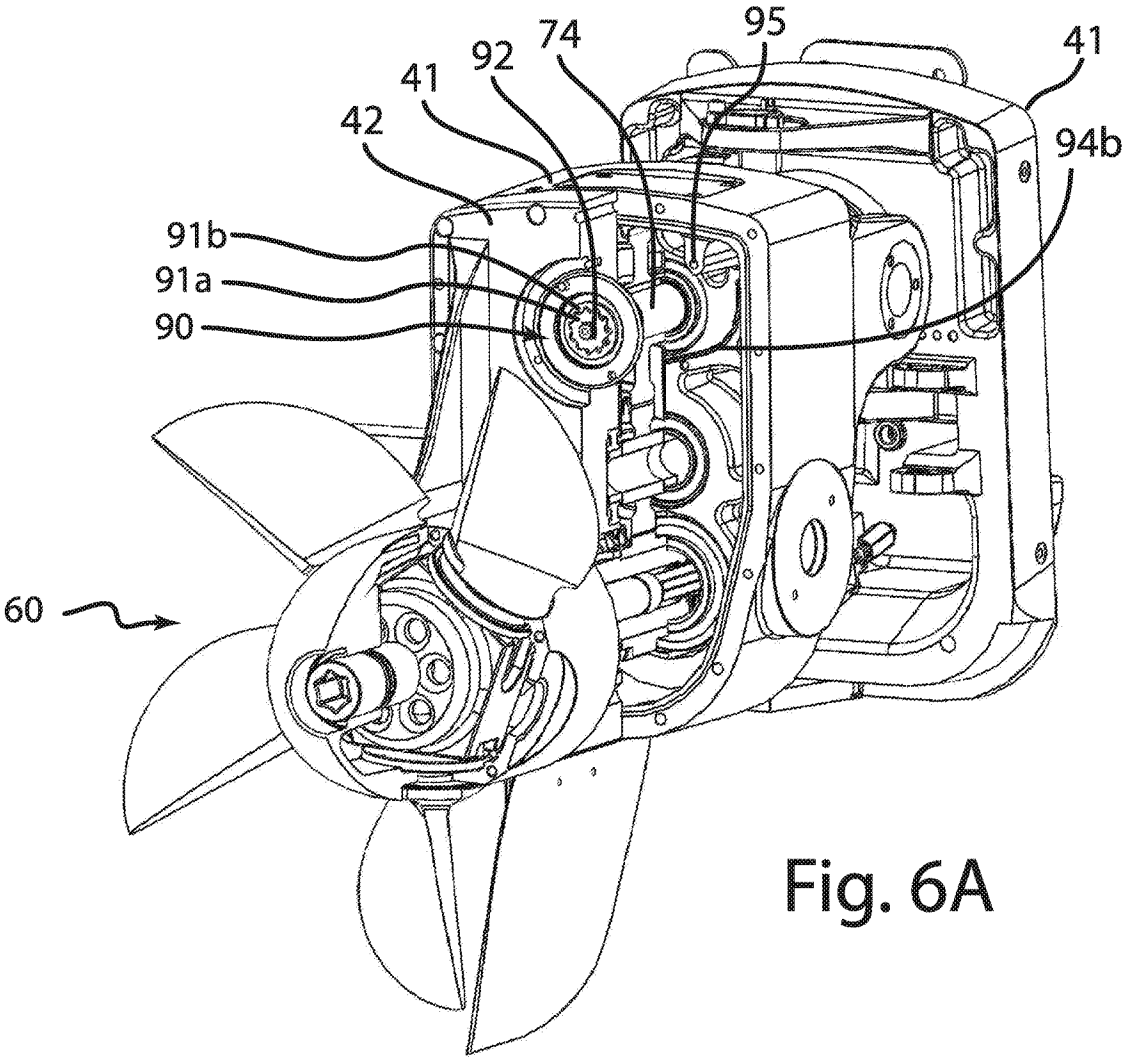
FIG. 6A is a rear perspective view of the marine surface propulsion device embodiment of FIG. 1 with portions of a support member and variable pitch propeller thereof cut away.
Figure 6B:
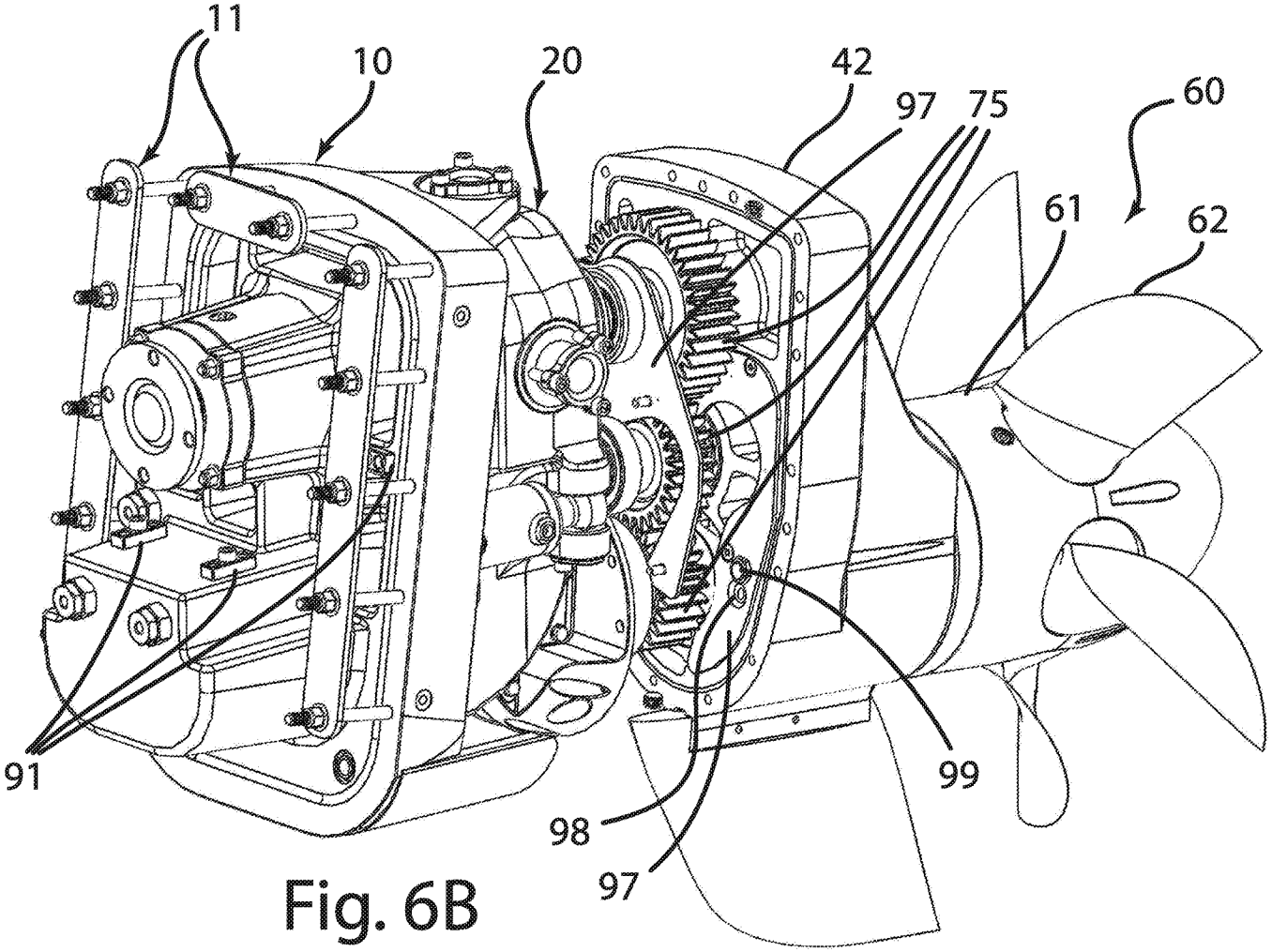
FIG. 6B is a front perspective view of the marine surface propulsion device embodiment of FIG. 1 with a forward support member of a support member thereof removed.
Figure 6C:
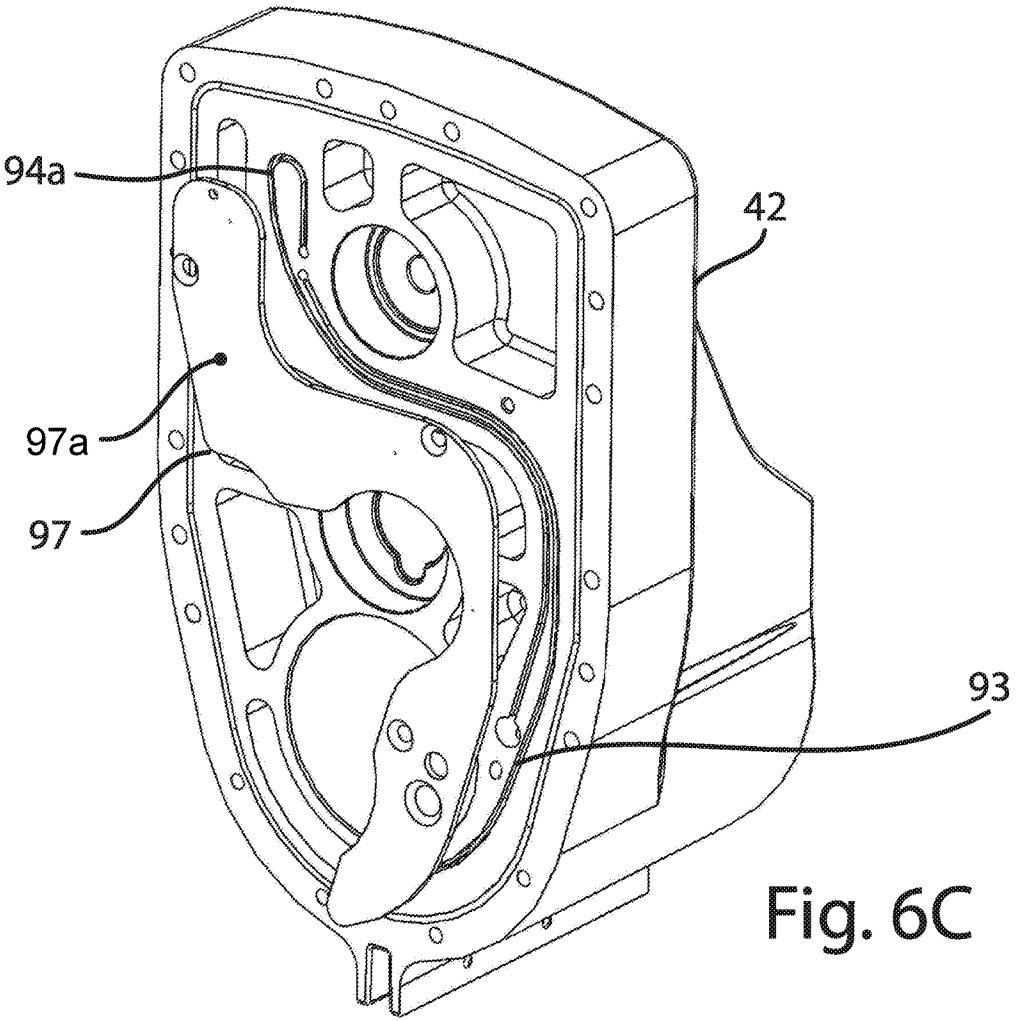
FIG. 6C is a front perspective view of a rearward support member of the support member shown in FIGS. 6A and 6B.

The support member 40 may include a forward support member 41 and a rearward support member 42 removably interconnectable to the forward support member 41. The forward support member 41 and rearward support member 42 may define the sealed internal volume within support member 40 for housing the plurality of meshing gears 75 and other interconnected componentry. In that regard, and as illustrated in FIGS. 6A, 6B and 6C, oiling of the plurality of meshing gears 75 and various associated bearings within the support member 40 may be accomplished with a gerotor pump 90 located in the rearward support member 42. Use of an oil circulating pump reduces the volume of oil required for lubrication of the various gears and bearings. It also reduces parasitic losses due to oil drag within the gear train defined by the plurality of meshing gears 75. The gerotor pump 90 comprises an inner rotor 91*a* and an outer rotor 91*b*. The inner rotor 91*a* is driven by a pin 92 that is rotated by an extension of the input shaft 74. As the gerotor set rotates a suction side of the gerotor pump 90 draws lubricating oil through an oil channel 93 from the bottom of the internal volume of the support member 40. The pressure side of the gerotor pump 90 routes pressurized lubricant through two channels, a first channel 94*a* in the rearward support member 42 and, utilizing a cross-over port 95, a second channel 94*b* in the forward support member 41. Cover plates 97 are provided on a forward facing side of the rearward support member 42 and on a rearward facing side of the forward support member 41, to enclose the first channel 94*a* and second channel 94*b*, respectively. In turn, small holes or jets 97*a* are located in cover plates 97 so as to spray oil from the pressurized oil channels 94*a*, 94*b* into the teeth comprising the plurality of meshing gears 75 on both sides thereof. At the end of the first channel 94*a* and the rearward support member 42, an over-pressure discharge port 98 and a pressure regulator 99 may be provided, thereby providing for the return of excess oil to the bottom of the internal volume of the support member 40.

With further reference to FIG. 2, the variable pitch actuator 50 may include a housing 51 fixedly interconnected to the support member 40 to maintain a sealed internal volume there within, and a piston member 52 disposed within a cylinder portion of the housing 51 for rotational and linear movement relative thereto. In turn, the piston member 52 may be interconnected to a force rod 55 that extends through the first end of a hollow propeller shaft 76 and is interconnected at a second end to pitch control member 63, wherein linear movement of the pitch control member 63 adjusts the pitch orientation of the propeller blades 62, as will be further described.

Figure 5:
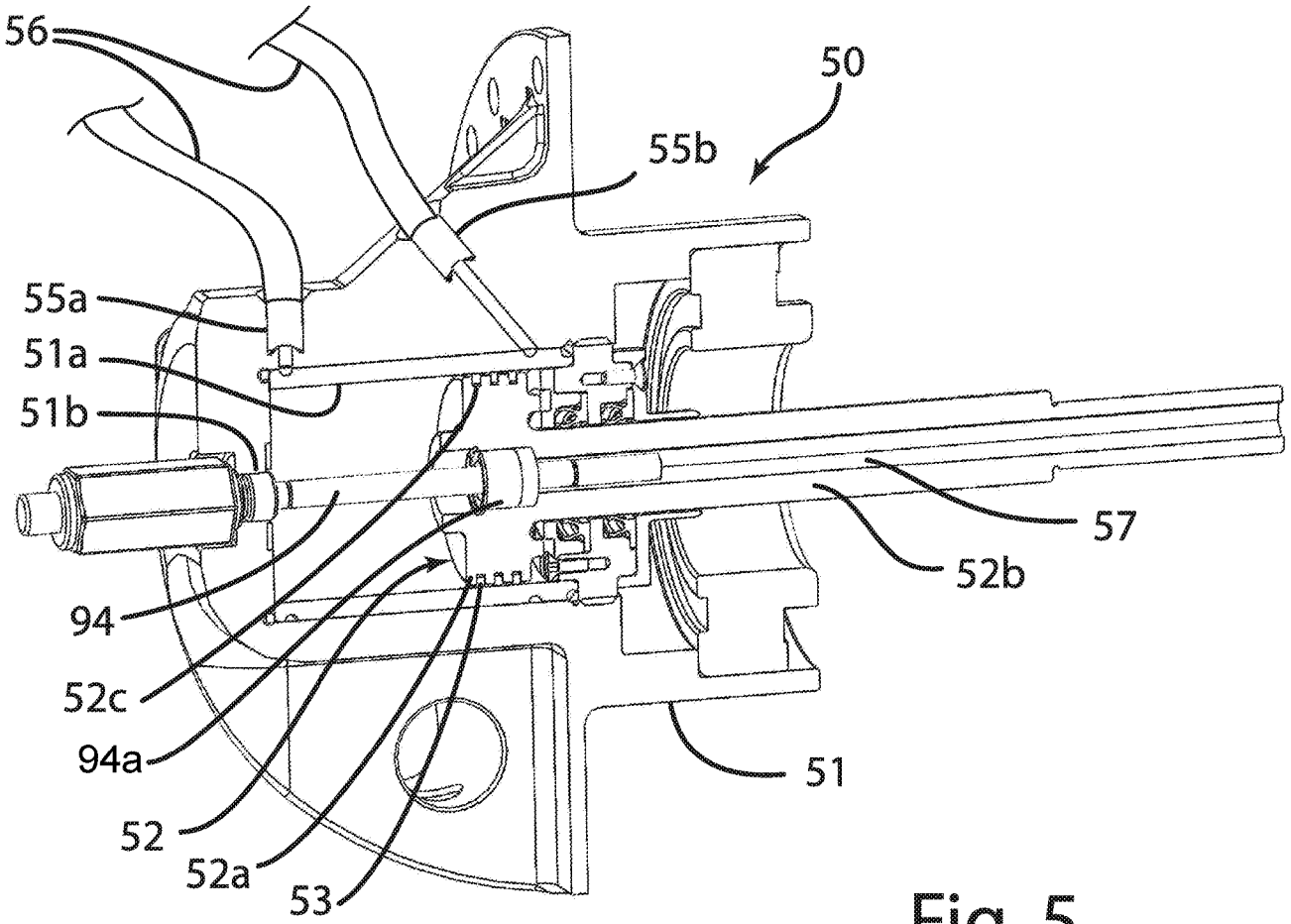
FIG. 5 is a side cross-sectional view of a variable pitch actuator comprising the marine surface propulsion device embodiment of FIG. 1.

Reference is now made to FIG. 5. As shown, piston member 52 may include a piston head portion 52*a* and an integral piston rod portion 52*b* (e.g. of one-piece construction) that slidably and sealably extends through an aperture of housing 51 for interconnection with the force rod 55 shown in FIG. 2. In that regard, piston rod portion 52*b* may be through-broached, e.g. to define a hex keyway 57. In turn, and as shown in FIG. 2, force rod 55 may be milled with wrench flats 55*a*, wherein the piston rod portion 52*b* may be threaded in to the force rod 55. As noted above, the force rod 55 may extend through the propeller shaft 76 (e.g. through an internal bore), and through the hub body 61.

With further reference to FIG. 5, the piston member 52 may include a plurality of piston rings 53 partially disposed within a corresponding plurality of grooves 52*c* with exposed portions disposed to slidably engage an inner surface 51*a* of the housing 51, thereby providing both rotational and linear sealing of the variable pitch actuator 50. To provide for linear displacement of the piston member 52, variable pitch actuator 50 may comprise a first hydraulic fluid inlet/outlet port 55*a* located in a foreward portion of the housing 51, and a second hydraulic fluid inlet/outlet port 55*b* located in aftward portion of the housing 51. As may be appreciated, flexible hydraulic fluid lines 56 may be interconnected to a hydraulic fluid control unit (e.g. located on a watercraft) to selectively control the passage of hydraulic fluid in to and out of chamber regions of the cylinder portion of housing 51, fore and aft the piston head portion 52*a* of piston member 52 to effect a desired linear positioning of the piston member 52, and in turn, pitch control member 63 to thereby control the pitch orientation of the propeller blades 62. Such pitch positioning may be completed while the propeller blades 62 are rotating with hub body 61, propeller shaft 76 and piston member 53, and during trimming and/or steering operations.

Figure 7A:
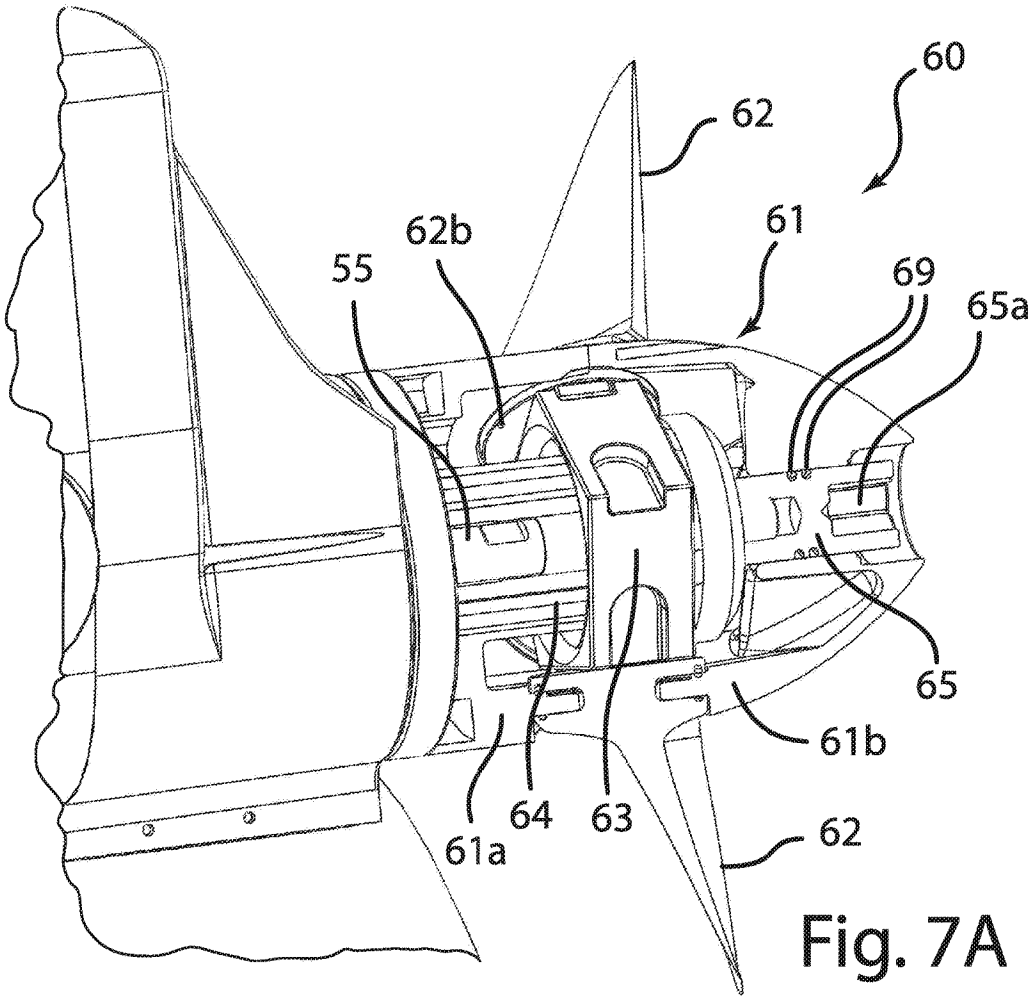
FIG. 7A is side perspective view of a variable pitch propeller of the marine surface propulsion device embodiment of FIG. 1 with portions of a hub body thereof cut away.

More particularly, reference is now made to FIG. 7A-7F which illustrate additional features of the variable pitch propeller 60. As shown in FIG. 7A, hub body 61 may comprise a foreward section 61*a* and an aftward section 61*b* that meet along a plane defined by the pivot axes of the propeller blades 62. The foreward section 61*a* may have an internal tubular boss 64 that extends aftward to a terminus to the aft of the plane of the pivot axis of the propeller blades 62. The pitch control member 63 may be attached to the force rod 55 and secured axially by a complimentary nut 65 and rotationally by a polygonal outer configuration of the pitch control member 63 (e.g. pentagonal in the illustrated embodiment), or by a key and force rod keyway. The complimentary nut 65 may be tightened to the piston rod portion 52*b* and force rod 55 via a hex or square socket 65*a* in the complimentary nut 65 and via the hex keyway 57 in the piston rod portion 52*b* that may be accessed through an aperture 51*b* in the variable pitch actuator housing 51, as shown in FIG. 5.

Figure 7B:
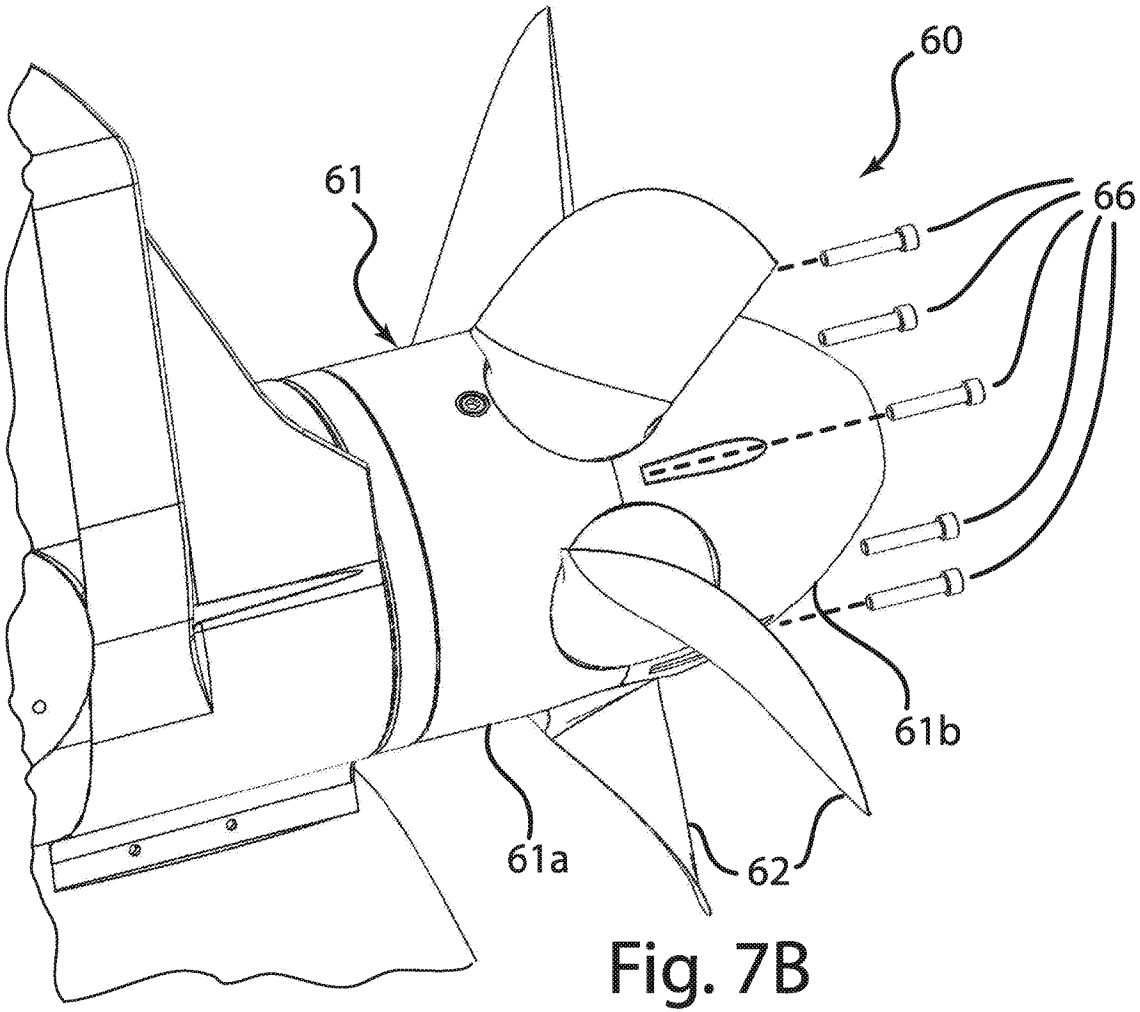
FIG. 7B is a side perspective view of the variable pitch propeller illustrated in FIG. 7A.
Figure 7C:
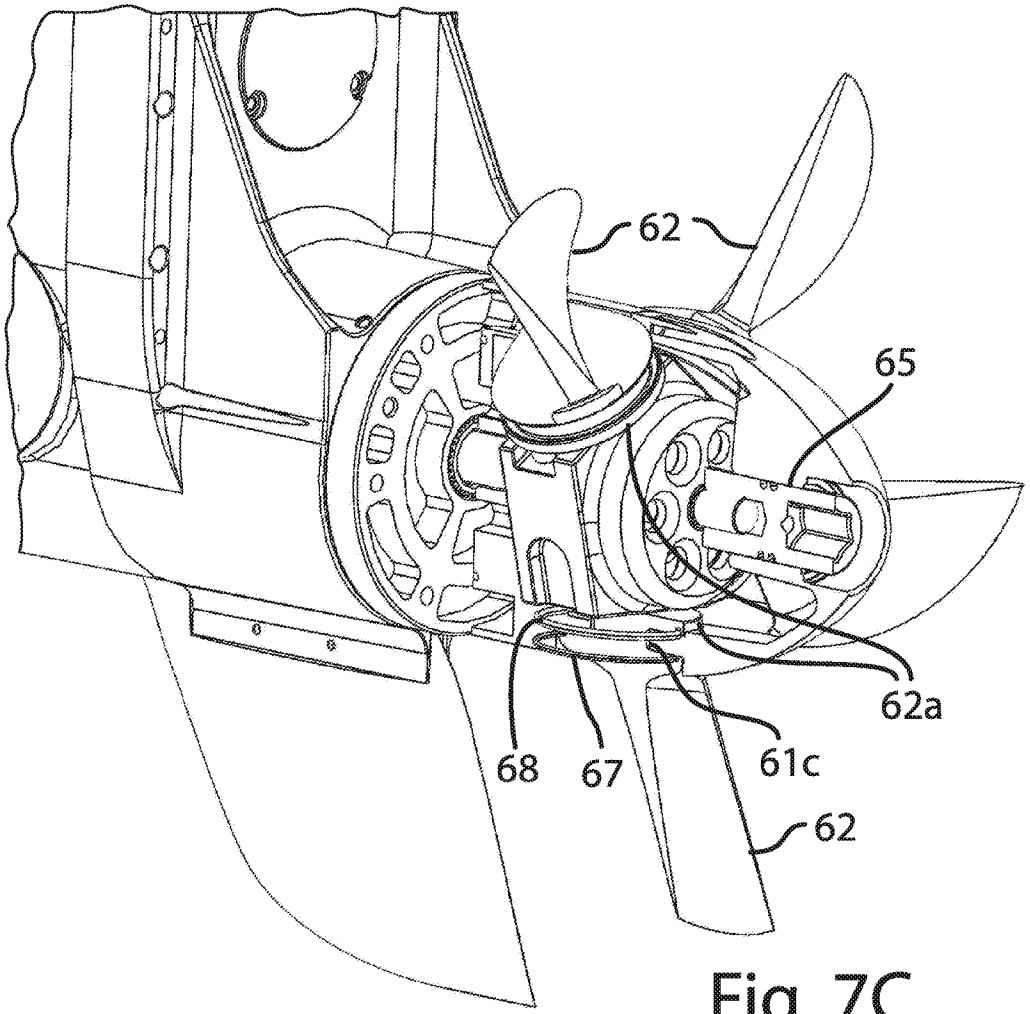
FIG. 7C is another side perspective view of the variable pitch propeller illustrated in FIG. 7A with different portions thereof cut away.

As illustrated in FIG. 7B, the foreward section 56 and aftward section 57 of the hub body 61 may be adjoined by bolts 66, thereby capturing blade flanges 62*a* of each of the propeller blades 62, as shown in FIG. 7C. In that regard, each of the propeller blades 62 may extend radially from a corresponding blade flange 62*a* and are received by corresponding mounting sockets 61*c* defined by the foreward section 61*a* and aftward section 61*b* of the hub body 61. Axial outside o-ring seal members 67 may be provided and are compressed during assembly while axial inside o-ring seal members 68 may be placed flush with each blade flange 62*a*. During operation, centripetal force radially displaces the inside o-ring seal members 68 on the inside surface of the corresponding blade flange 62*a* for a positive seal. Relief passageways 62*b* may be provided through blade flanges 62*a* to prevent blocking of the o-ring seal members in the groove (e.g. blocking that may otherwise occur due to suction forces sufficient to prohibit centripetal radial movement and subsequent sealing), as shown in FIG. 7A.

As shown in FIG. 4, the external surface of the hub body 61 may be of a streamlined configuration. At higher speeds, the propeller blades 62 may be designed to super cavitate within the outside diameter profile of the hub body 61 spinning above the water surface, with the propeller blades 62 entering and exiting the water surface each revolution of the propeller shaft 76 for minimum drag.

Figure 7D:
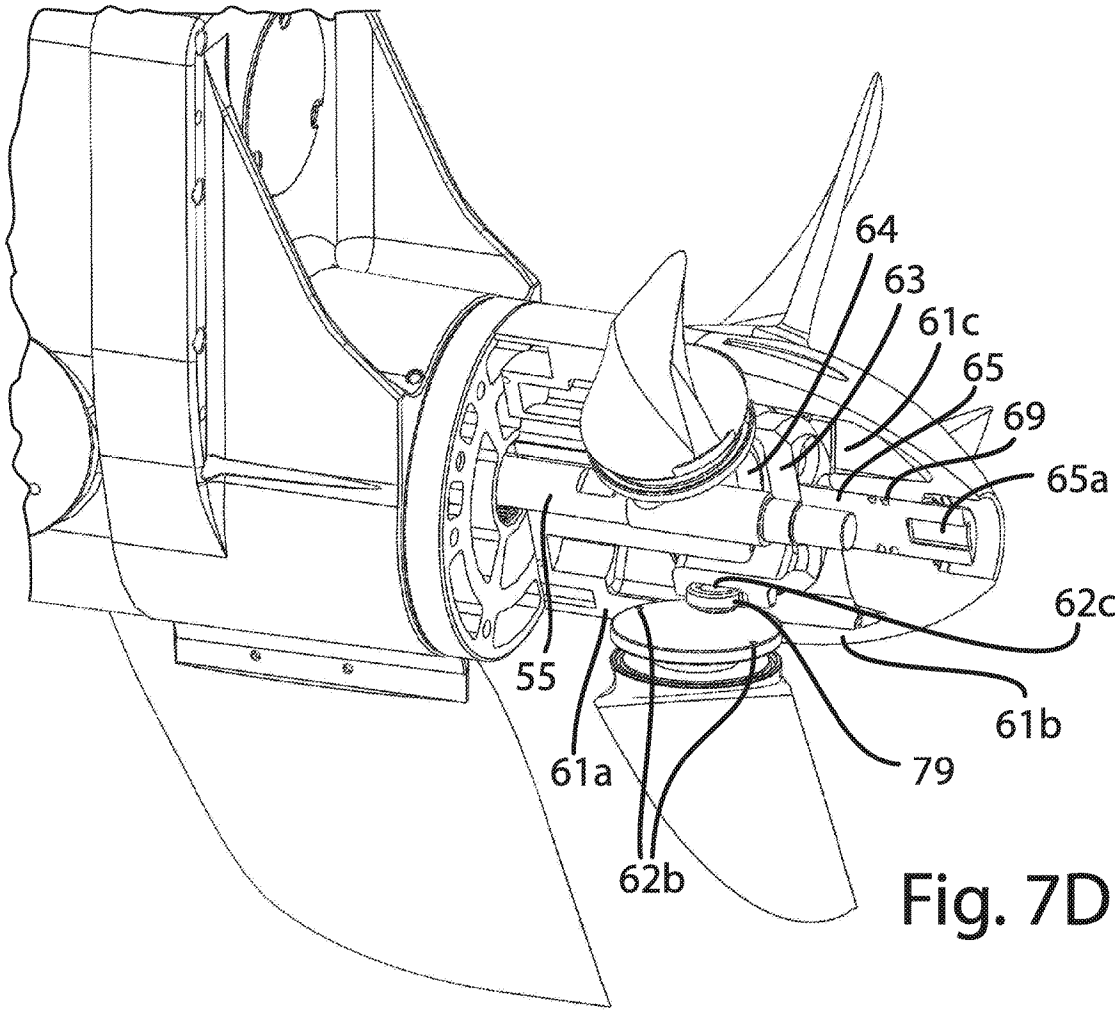
FIG. 7D is another side perspective view of the variable pitch propeller illustrated in FIG. 7A with different portions thereof cut away.

As shown in FIG. 7D, the complimentary nut 65 may be received in and sealed to the aftward hub section 61*b* by sealing rings 69. An eccentric crank pin 62*c* may project inwardly in to the cavity of the hub body 61 from the blade flange 62*a* of each of the propeller blades 62. In the neutral (i.e. near-zero pitch) settings of the propeller blades 62, the crank pins 62*c* may be offset circumferentially from the blade pivot axes and centered substantially on the plane of the pivot axes.

Figure 7E:
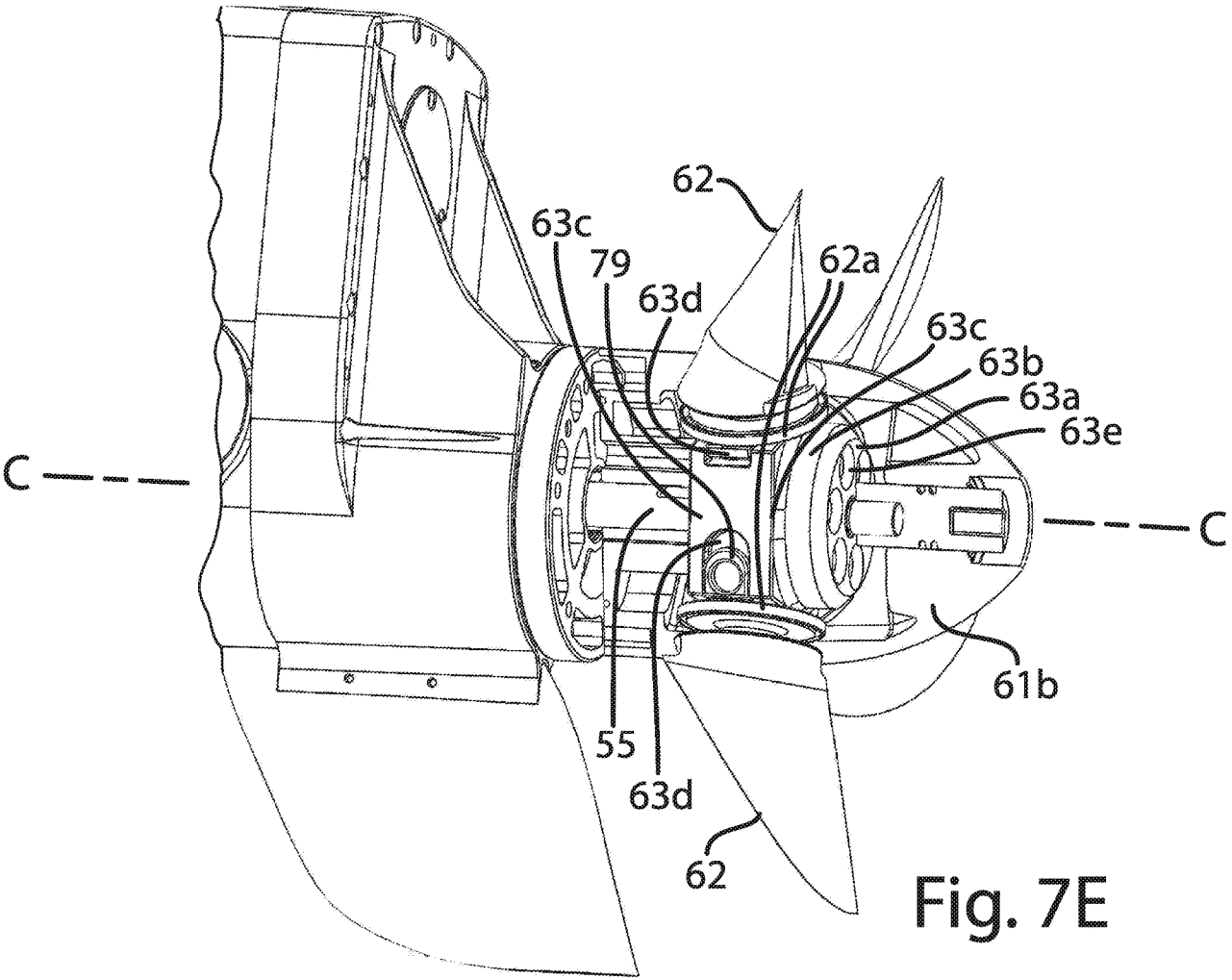
FIG. 7E is another side perspective view of the variable pitch propeller illustrated in FIG. 7A with different portions thereof cut away.

As noted above, the force rod 55 extends through the propeller shaft 76 from the variable pitch actuator 50 to move pitch control member 63 foreward and aftward. As shown in FIG. 7E, the pitch control member 63, may include a round base portion 63*a* and a tubular portion 63*b* extending forward from the perimeter of the base portion 63*a*. The tubular portion 63*b* may transform to a polygonal portion 63*c* having a polygonal configuration (e.g. pentagon in the illustrated embodiment) at its peripheral surface. At the location of each of the crank pins 62*c* each section of the polygonal portion 63*c* may be provided with a slideway 63*d* oriented transversely of the axis CC of the propeller shaft 76, and each slideway 63*d* may receive a cross slide 79. In turn, each cross slide 79 may receive a crank pin 62*c* of a corresponding propeller blade 62, as further shown in FIG. 7D.

In a right-hand rotation drive arrangement, when the force rod 55 and pitch control member 63 are pulled forward from a neutral position by the variable pitch actuator 50, the propeller blades 62 may be rotated clockwise, which will adjust the propeller blades 62 to deliver astern thrust. That is, forward positioning of variable pitch actuator 50 and clockwise blade rotation decreases pitch and thrust. Conversely, when the force rod 55 is pushed aftward by the variable pitch actuator 50, the propeller blades 62 may be pivoted to deliver decreased pitch and lesser astern thrust. That is, aftward positioning of variable pitch actuator 50 and counter clockwise blade rotation increases pitch and thrust. In that regard, the variable pitch actuator 50 may be suitably controlled to provide a continuum of settings between maximum and minimum pitches for astern thrust. In the case of reverse thrust at an idling speed when the variable pitch propeller 60 is submerged, water deflectors 47 (shown in FIG. 4) may be provided to direct water flow beneath the hull of a watercraft rather than in to the aft transom surface, for reverse authority. In a left hand rotation drive arrangement, when the force rod 55 and pitch control member 63 are pushed aftward from the neutral position by the variable pitch actuator 50, the propeller blades 62 may be rotated counter-clockwise, which adjusts the propeller blades 62 to deliver increased pitch and greater astern thrust. Pressure to the variable pitch actuator 50 may be supplied via the hydraulic lines 56 and pressure ports 55*a*, 55*b* noted above in relation to FIG. 5, and transfer blocks 91 shown in FIG. 6C from an interconnectable pump and reservoir provided on board a watercraft.

With further reference to FIG. 7D, travel of the pitch control member 63 is limited in the forward direction by contact between the base portion 63*a* and the tubular boss 64. Travel of the pitch control member 63 is limited in the aftward direction by contact of the base portion 63*a* with internal ribs 61*c* of the aftward propeller hub 61*b*. Alternatively, travel could be limited by the length of the slideways 63*d* for cross slides 79 and, thereby, restrict cross slide travel and blade rotation. At one extreme of travel, the propeller blades 62 are nearly feathered at a very low pitch, which enables extremely low speed progress. At the other extreme of travel, the propeller blades 62 are almost paddle-wheel-like at infinite pitch, which enables lateral movement of a watercraft when used in conjunction with a bow thruster. As shown in FIG. 7E, the force rod 55 and pitch control member 63 need not be rotationally fixed to the hub body 61 or propeller shaft 76 because the hub body 61 imparts rotation to them through engagement of the peripheral surface of polygonal portion 63*c* of the pitch control member 63 on the propeller blade flanges 62*a* of the propeller blades 62.

Figure 7F:
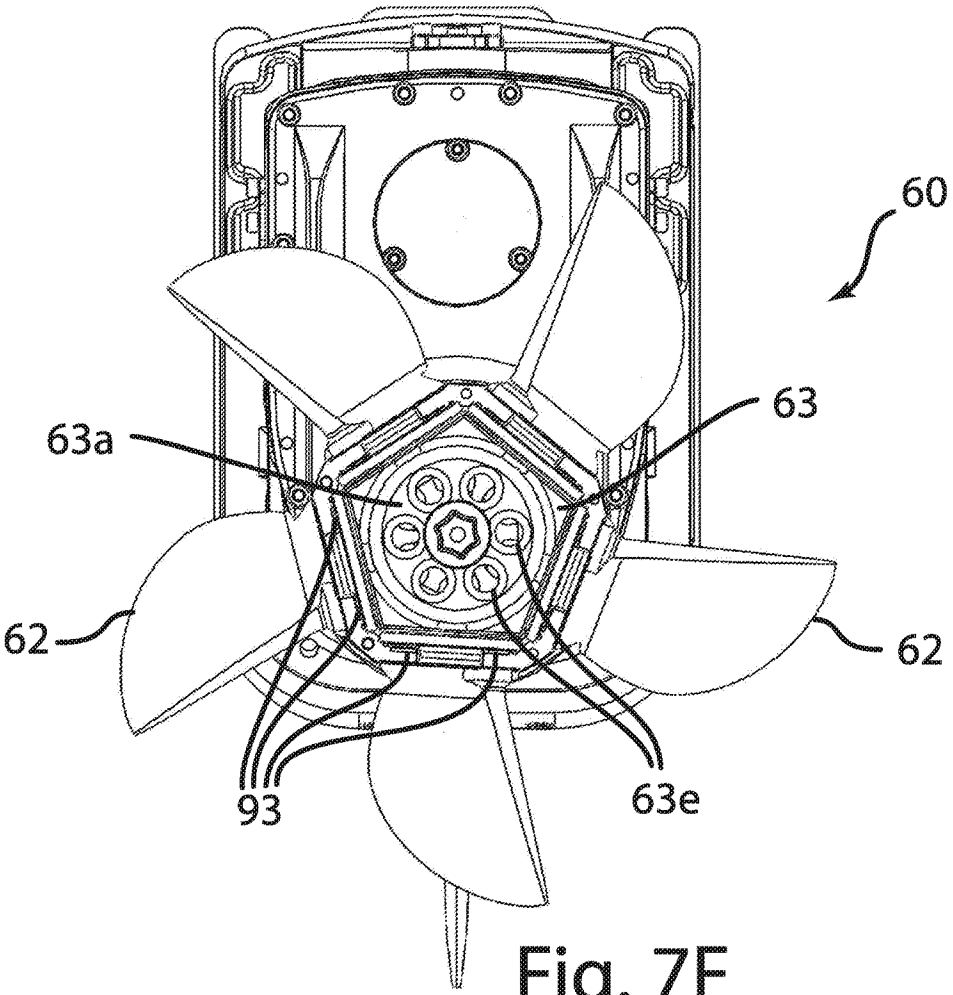
FIG. 7F is a rear view of the variable pitch propeller illustrated in FIG. 7A with a portion of the hub body thereof cut away.

The cavity of the hub body 61 may be suitably sealed and filled with grease through a plugged grease hole 61*d*, as shown in FIG. 3. As shown in FIG. 7F, the round base 63*a* of the pitch control member 65 may have holes 63*e* through it to allow the movement of the pitch control member 63 through the grease. Grease can also readily displace through openings 93 between the forward hub section 61*a* cavity walls and the pitch control member 63.

As shown in FIG. 5, the axial position of the piston member 52 of the variable pitch actuator 50 may be read by a sensor 94, e.g. Hall effect sensor 94 passing through a magnet 94*a* within the piston member 52. Because the piston rod portion 52*b*, force rod 55 and pitch control member 63 are secured along the longitudinal axis CC, piston member 52 position correlates to blade pitch position. Similarly, another sensor 96 may communicate the position of piston member 82 of trim actuator 80. In that regard, sensor 94 and/or sensor 96 may provide a corresponding sensor output signal(s) that may be processed by a computer processor configured by preprogrammed instructions that utilize control algorithms to automatically control the operation of the variable pitch actuator 50 to position the propeller blades 62.

As shown in FIG. 2, supply voltage and position voltages are transmitted through water sealed electronic cables 87. Watertight thru hull fittings 98 pass cable to an on-board microcomputer. Control algorithms may set and maintain propeller pitch and/or trim geometry for optimal acceleration or fuel economy depending on throttle position and engine rpm, torque and fuel consumption profiles.

Figure 8:
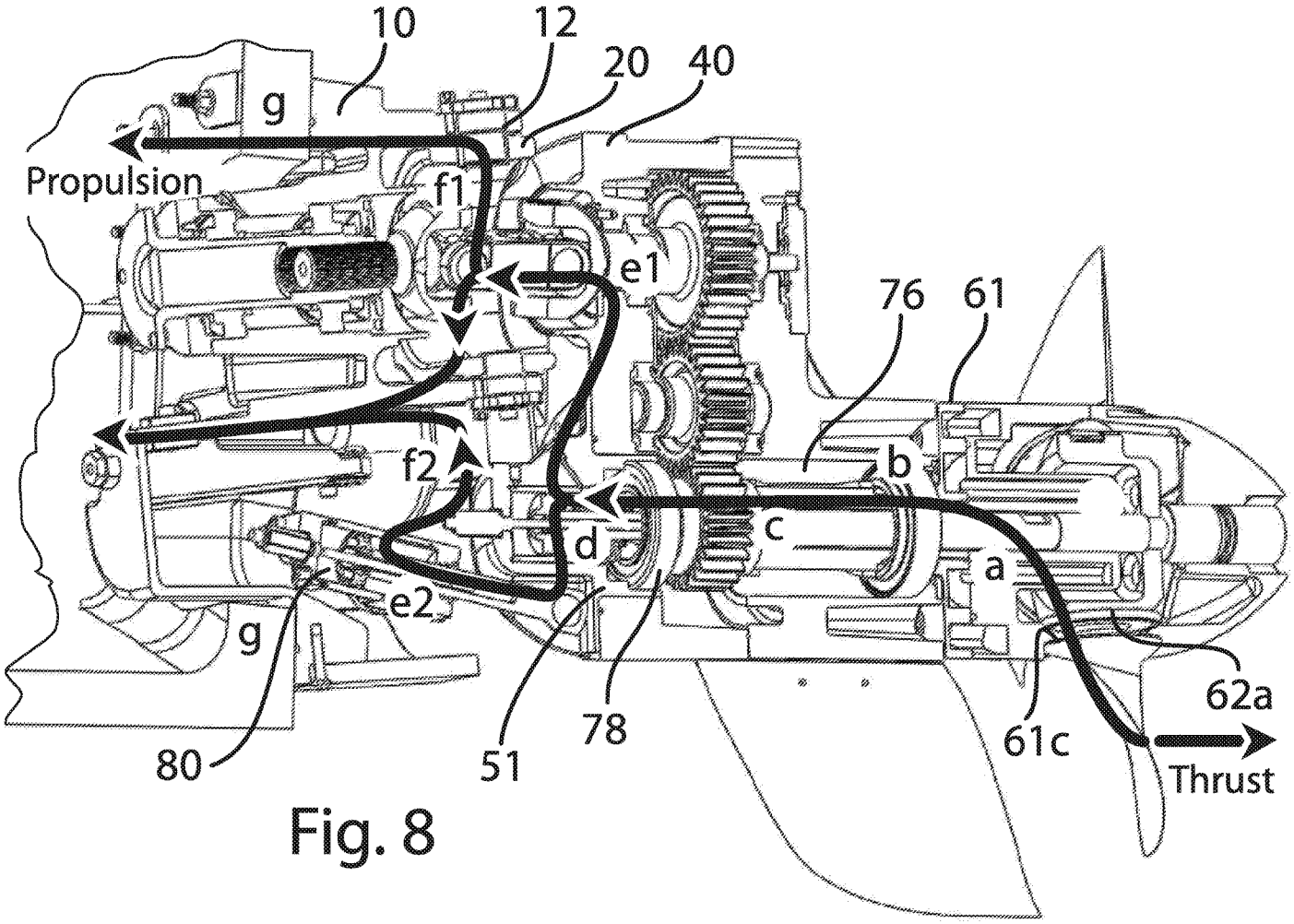
FIG. 8 is a propulsion force delivery diagram for the marine surface propulsion device embodiment of FIG. 1.

With reference now to FIG. 8, propulsive reaction to propeller thrust is transmitted sequentially through the propulsion device 1 as follows:

a) from the blade flanges 62*a* and sockets 61*c* to the hub body 61;

b) to the propeller shaft 76;

c) to the tapered roller bearing 78;

d) to the variable pitch actuator housing 51, from which the force divides along two paths, e1 and e2;

e1) to the support member 40 into the gimbal member 20; and, e2) to the trimming actuator 80 into the gimbal member 20;

f1) from the gimbal member 20 through arms 12 of the transom member 10; and, f2) from the gimbal member 20 through steering actuator(s) member 30 to the transom housing member 10; and, g) from the transom member 10 to the watercraft transom 124.

Figure 9A:
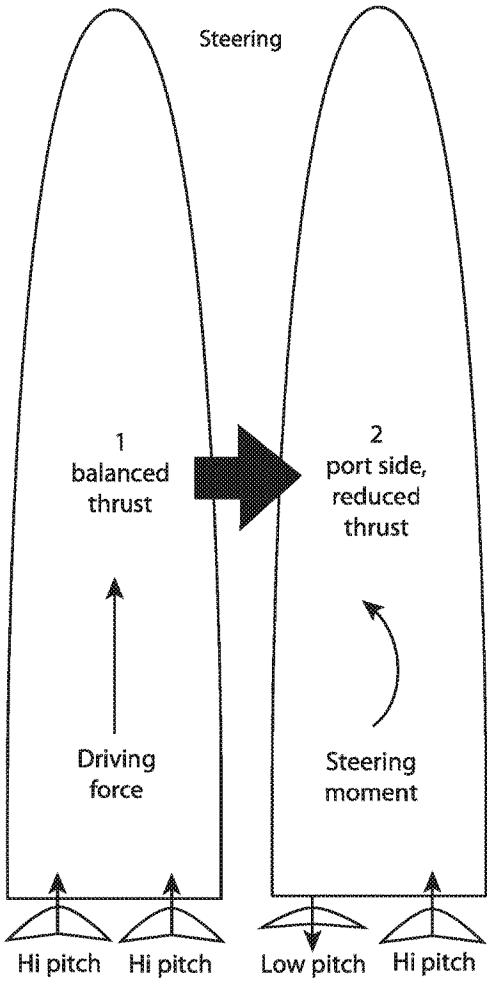
FIG. 9A is a schematic illustration of an embodiment that includes embodiments of two marine surface propulsion devices, each as described in relation to FIGS. 1-8, interconnected to a watercraft on different sides of a longitudinal axis thereof, wherein the variable pitch actuators of the two marine surface propulsion devices may be selectively and automatically controlled to facilitate steering of the watercraft.
Figure 9B:
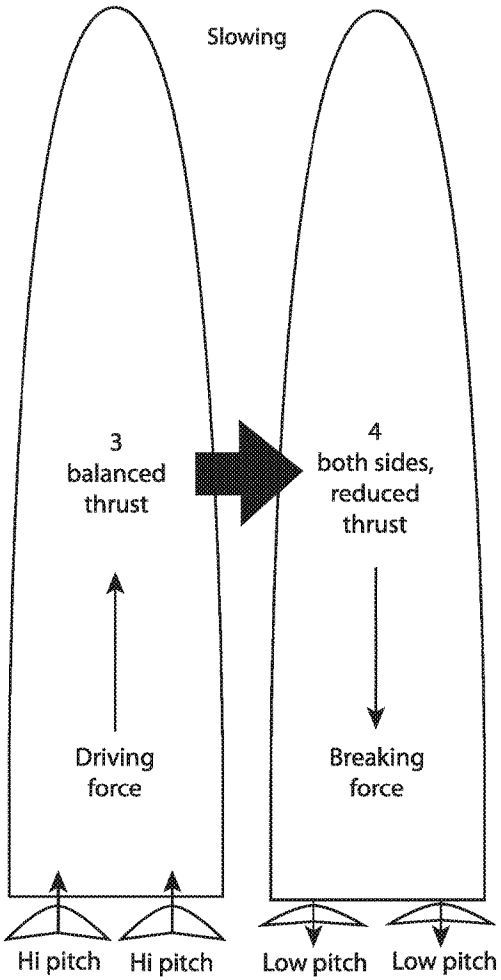
FIG. 9B is a schematic illustration of an embodiment that includes embodiments of two marine surface propulsion devices, each as described in relation to FIGS. 1-8, interconnected to a watercraft on different sides of a longitudinal axis thereof, wherein the variable pitch actuators of the two marine surface propulsion devices may be selectively and automatically controlled to facilitate slowing of the watercraft.

Reference is now made to FIGS. 9A and 9B, in which at least two marine surface propulsion devices having features as described herein may be provided for supportable interconnection to and pivotable movement about a first axis and/or second axis relative to a watercraft transom. For example, a first propulsion device may be provided for interconnection to a watercraft transom on a first side (e.g. a port side) of a longitudinal axis (e.g. a lengthwise axis) of a watercraft, and a second propulsion device may be provided for interconnection to a watercraft transom on a second side (e.g. a starboard side) of the longitudinal axis of a watercraft. In turn, control algorithms may be provided so that the controller may automatically control the variable pitch actuators of the first and second propulsion devices in relation to steering and/or slowing, (e.g. "breaking") of the watercraft.

For example, and as illustrated in FIG. 9A, preprogrammed instructions may be provided with control algorithms so that, in response to processing of a steering control (e.g. a signal indicative of a position of a watercraft steering wheel and/or a signal indicative of a position of a piston member of a steering actuator) indicative of operator steering of a watercraft to the left (i.e. to the port side), the controller may automatically control the first and second variable pitch actuators so that the propeller blades of the first variable pitch actuator automatically assume a first predetermined pitch orientation in relation to the desired steering moment and the propeller blades of the second variable pitch actuator automatically assume a second predetermined pitch orientation in relation to the desired steering moment, wherein the second predetermined pitch orientation is higher than the first predetermined pitch orientation. Conversely, the preprogrammed instructions may be provided with control algorithms so that, in response to processing of a steering control sensor signal (e.g. a signal indicative of a position of a watercraft steering wheel and/or a signal indicative of a position of a piston member of a steering actuator) indicative of operator steering of a watercraft to the right (i.e. to the starboard side), the controller may automatically control the first and second variable pitch actuators so that the propeller blades of the first variable pitch actuator automatically assume a first predetermined pitch orientation in relation to the desired steering moment and the propeller blades of the second pitch actuator automatically assume a second predetermined pitch orientation in relation to the desired steering moment, wherein the second predetermined pitch orientation is lower than the first predetermined pitch orientation. Further, and as illustrated in FIG. 9B, preprogrammed instructions may be provided that use control algorithms so that, in response to a watercraft engine throttle sensor output signal indicative of operator slowing of a watercraft, the controller may automatically control the first and second variable pitch actuators to reduce the magnitude of the pitch orientation of the propeller blades to a lower pitch orientation as a function of the desired degree of slowing.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain known modes of practicing the invention and to enable others skilled in the art to utilize the invention in such or other embodiments and with various modifications required by the particular application(s) or use(s) of the present invention. It is intended that the appended claims be construed to include alternative embodiments to the extent permitted by the prior art.

What is claimed is:

1. A device for marine surface propulsion of a watercraft, comprising:

a support member supportably interconnectable to and pivotable about at least a first axis relative to a watercraft transom;

a propeller shaft supported by said support member for pivotable movement therewith about said first axis and rotatable relative to the support member, wherein a first end of the propeller shaft is interconnectable to a watercraft engine output for driven rotation thereby;

a hub body interconnected to a second end of the propeller shaft for co-rotation therewith, wherein the hub is pivotable with the support member about the first axis;

a plurality of propeller blades projecting away from the hub body and interconnected to the second end of the propeller shaft for co-rotation therewith, wherein the plurality of propeller blades are pivotable with the support member about the first axis;

a variable pitch actuator, interconnected to said support member for pivotable co-movement therewith about said first axis, for adjustably controlling a pitch orientation of said plurality of propeller blades relative to a longitudinal axis of the propeller shaft, wherein said variable pitch actuator is a linear actuator comprising:

a housing fixedly interconnected to said support member; and, a piston member disposed for co-rotation with the propeller shaft and having an end slidably disposed within said housing for linear and rotational movement relative thereto, wherein said linear actuator is actuatable to control linear movement of the piston member and thereby adjust said pitch orientation of said plurality of propeller blades.

2. A device as recited in claim 1, wherein said first axis is a reclined axis, and further comprising:

a trimming actuator for adjustably pivoting together said support member, propeller shaft, hub body, plurality of propeller blades and variable pitch actuator about the first axis.

3. A device as recited in claim 1, wherein said first axis is an upright axis, and further comprising:

at least one steering actuator for adjustably pivoting the support member, propeller shaft, hub body, plurality of propeller blades and variable pitch actuator about the first axis.

4. A device as recited in claim 1, wherein said support member is pivotable about a second axis, said first axis and said second axis being transverse and each extending within a substantially common plane, and wherein said propeller shaft, hub body, plurality of propeller blades and variable pitch actuator are pivotable with said support member about said second axis.

5. A device as recited in claim 4, wherein said first axis is an upright axis, and further comprising:

a gimbal member supportably interconnectable to and pivotable about said first axis relative to a watercraft transom, wherein said support member is supportably interconnected to and pivotable about said first axis with said gimbal member.

6. A device as recited in claim 5, further comprising:

at least one steering actuator interconnectable between a watercraft transom and said gimbal, for adjustably pivoting together said gimbal, support member, propeller shaft, hub body, plurality of propeller blades and variable pitch actuator about said first axis.

7. A device as recited in claim 6, wherein said second axis is a reclined axis and said support member is supportably interconnected to and pivotable about the second axis relative to said gimbal, and further comprising:

a trimming actuator, interconnected between said gimbal member and said support member, for adjustably pivoting said support member, propeller shaft, hub body, plurality of propeller blades and variable pitch actuator about said second axis.

8. A device as recited in claim 7, further comprising:

an input shaft supported by said support member for pivotable movement therewith about said first axis and said second axis, and rotatable relative to the support member, wherein the input shaft is interconnectable to a watercraft engine output for driven rotation thereby; and, a plurality of meshing gears, wherein a first gear of said plurality of meshing gears is fixedly interconnected to said input shaft for co-rotation therewith, wherein a second gear of said plurality of meshing gears is disposed to rotate in response to rotation of said first gear, and wherein said first end of said propeller shaft is fixedly interconnected to said second gear for co-rotation therewith.

9. A device as recited in claim 8, further comprising:

a first universal joint supportably interconnectable to a watercraft transom and rotatably interconnectable to a watercraft engine output for rotation thereby; and, a second universal joint supported by said support member for pivotable movement therewith about said first axis and said second axis, and rotatably interconnected to said first universal joint for co-rotation therewith.

10. A device as recited in claim 9, wherein said first universal joint and said second universal joint are interconnected free from direct connection with said gimbal member.

11. A device as recited in claim 7, further comprising:

a controller for automatically controlling operation of said variable pitch actuator concurrent with operation of either or both of said at least one steering actuator and said trimming actuator.

12. A device as recited in claim 5, wherein said second axis is a reclined axis, wherein said support member is supportably interconnected to and pivotable about the second axis relative to said gimbal, and further comprising:

a trimming actuator, interconnectable between said gimbal member and said support member, for adjustably pivoting together said support member, propeller shaft, hub body, plurality of propeller blades and variable pitch actuator about said second axis.

13. A device as recited in claim 12, wherein said trimming actuator is a linear actuator comprising:

a housing supportably interconnected to one of the gimbal member and the support member; and, a piston member having an end slidably disposed within said housing for linear movement relative thereto, and another end supportably interconnected to the other one of the gimbal member and the support member.

14. A device as recited in claim 1, further comprising:

a force rod having a first end interconnected to said piston member for linear and co-rotational movement therewith, and having a second end interconnected to said second end of said propeller shaft for co-rotation therewith, wherein said pitch orientation of said plurality of propellers is adjustable in response to the linear movement of the piston member force rod by said piston member.

15. A device as recited in claim 14, further comprising:

a pitch control member fixedly interconnected to said second end of said propeller shaft for co-rotation therewith and to said second end of said force rod for linear and co-rotational movement therewith, wherein said pitch orientation of said plurality of propellers is adjustable in response to the linear movement of the pitch control member by said force rod and said piston member.

16. A device as recited in claim 15, wherein said plurality of propeller members engage different corresponding ones of a plurality of guide surfaces provided by said pitch control member so as to rotate said plurality of propeller members about corresponding axes to adjust said pitch orientation in response to the linear movement of the pitch control member by said force rod and said piston member.

17. A devices as recited in claim 15, wherein at least a portion of the propeller shaft is tubular, and wherein said force rod extends through at least a portion of said tubular portion of the propeller shaft.

18. A device as recited in claim 14, wherein said propeller shaft is tubular, and wherein said force rod extends through said propeller shaft from the first end to the second end thereof.

19. A device as recited in claim 1, wherein said linear actuator is hydraulically actuatable for reciprocal linear movement of the piston member relative to said housing.

20. A device as recited in claim 1, wherein said first axis is a reclined axis, and further comprising:

a trimming actuator for adjustably pivoting together said support member, propeller shaft, hub body, plurality of propeller blades and variable pitch actuator about the first axis, wherein said trimming actuator is interconnectable between said support member and a watercraft transom.

21. A device as recited in claim 1, wherein at least a portion of said variable pitch actuator is disposed within an internal volume of said support member.

22. A device as recited in claim 21, further comprising:

an input shaft supported by said support member for pivotable movement therewith about said first axis and said second axis, and rotatable relative to the support member, wherein the input shaft is interconnectable to a watercraft engine output for driven rotation thereby; and, a plurality of meshing gears, wherein a first gear of said plurality of meshing gears is fixedly interconnected to said input shaft for co-rotation therewith, wherein a second gear of said plurality of meshing gears is disposed to rotate in response to rotation of said first gear, and wherein said first end of said propeller shaft is fixedly interconnected to said second gear for co-rotation therewith;

wherein said input shaft and said plurality of meshing gears are disposed within said internal volume of said support member.

23. A device for marine surface propulsion of a watercraft, comprising:

a support member supportably interconnectable to and pivotable about at least a first axis relative to a watercraft transom;

a propeller shaft supported by said support member for pivotable movement therewith about said first axis and rotatable relative to the support member, wherein a first end of the propeller shaft is interconnectable to a watercraft engine output for driven rotation thereby;

a hub body interconnected to a second end of the propeller shaft for co-rotation therewith, wherein the hub is pivotable with the support member about the first axis;

a plurality of propeller blades projecting away from the hub body and interconnected to the second end of the propeller shaft for co-rotation therewith, wherein the plurality of propeller blades are pivotable with the support member about the first axis;

a variable pitch actuator, interconnected to said support member for pivotable co-movement therewith about said first axis, for adjustably controlling a pitch orientation of said plurality of propeller blades relative to a longitudinal axis of the propeller shaft and disposed for co-rotation with the propeller shaft, wherein said variable pitch actuator is a linear actuator comprising:

a housing fixedly interconnected to said support member;

a piston member having an end slidably disposed within said housing for linear and rotational movement relative thereto, wherein said linear actuator is actuatable to control linear movement of the piston member and thereby adjust said pitch orientation of said plurality of propellers;

a force rod having a first end interconnected to said piston member for linear and co-rotational movement therewith, and having a second end interconnected to said second end of said propeller shaft for co-rotation therewith, wherein said pitch orientation of said plurality of propellers is adjustable in response to the linear movement of the force rod by said piston member, wherein said propeller shaft is tubular, and wherein said force rod extends through said propeller shaft from the first end to the second end thereof; and, a pitch control member fixedly interconnected to said second end of said propeller shaft for co-rotation therewith and to said second end of said force rod for linear and co-rotational movement therewith, wherein said pitch orientation of said plurality of propellers is adjustable in response to the linear movement of the pitch control member by said force rod and said piston member.

* * * * *